US007823661B2

(12) United States Patent
Mintchev et al.

(10) Patent No.: US 7,823,661 B2
(45) Date of Patent: Nov. 2, 2010

(54) IN-DRILLING ALIGNMENT

(76) Inventors: Martin P. Mintchev, 531 Ranchridge Court, NW, Calgary, AB (CA) T3G1W8; Efraim Pecht, Department of Electrical and Computer Engineering, ICT 402, The University of Calgary, 2500 University Drive N.W., Calgary, Alberta (CA) T2N 1N4; Justin Cloutier, Department of Electrical and Computer Engineering, ICT 402, The University of Calgary, 2500 University Drive N.W., Calgary, Alberta (CA) T2N 1N4; Aleksandar Dzhurkov, Department of Electrical and Computer Engineering, ICT 402, The University of Calgary, 2500 University Drive N.W., Calgary, Alberta (CA) T2N 1N4

( * ) Notice: Subject to any disclaimer, the term of this patent is extended or adjusted under 35 U.S.C. 154(b) by 112 days.

(21) Appl. No.: 12/145,360

(22) Filed: Jun. 24, 2008

(65) Prior Publication Data

US 2009/0314546 A1 Dec. 24, 2009

(51) Int. Cl.
*E21B 47/024* (2006.01)

(52) U.S. Cl. ..... 175/61; 175/45; 73/152.46

(58) Field of Classification Search ..... 175/45, 175/61, 62; 73/152.46
See application file for complete search history.

(56) References Cited

U.S. PATENT DOCUMENTS

| | | | | | |
|---|---|---|---|---|---|
| 2,000,524 | A * | 5/1935 | Kothny et al. | ..... | 33/306 |
| 2,788,510 | A * | 4/1957 | Howes | ..... | 367/86 |
| 3,057,197 | A * | 10/1962 | Alexander et al. | ..... | 73/152.56 |
| 3,743,034 | A * | 7/1973 | Bradley | ..... | 175/61 |
| RE29,526 | E * | 1/1978 | Jeter | ..... | 175/73 |
| 4,192,077 | A | 3/1980 | Van Steenwyk et al. | | |
| 4,909,336 | A * | 3/1990 | Brown et al. | ..... | 175/45 |
| 5,103,920 | A * | 4/1992 | Patton | ..... | 175/45 |
| 6,145,378 | A * | 11/2000 | McRobbie et al. | ..... | 73/490 |
| 6,315,062 | B1 | 11/2001 | Alft et al. | | |
| 6,453,239 | B1 | 9/2002 | Shirasaka et al. | | |
| 6,564,883 | B2 * | 5/2003 | Fredericks et al. | ..... | 175/50 |
| 6,651,496 | B2 | 11/2003 | Van Steenwyk et al. | | |
| 6,714,870 | B1 * | 3/2004 | Weston et al. | ..... | 702/9 |
| 6,882,937 | B2 | 4/2005 | McElhinney | | |
| 6,895,678 | B2 | 5/2005 | Ash et al. | | |
| 6,957,580 | B2 * | 10/2005 | Ekseth et al. | ..... | 73/488 |
| 7,002,484 | B2 | 2/2006 | McElhinney | | |
| 7,506,696 | B2 * | 3/2009 | Weston et al. | ..... | 175/45 |
| 7,584,808 | B2 * | 9/2009 | Dolgin et al. | ..... | 175/45 |
| 2002/0133958 | A1 | 9/2002 | Noureldin et al. | | |
| 2005/0126022 | A1 | 6/2005 | Hansberry et al. | | |
| 2006/0006000 | A1 * | 1/2006 | Weston et al. | ..... | 175/45 |

OTHER PUBLICATIONS

Pecht, E., at al., "On Azimuth Observability During INS Alignment in Horizontal Drilling", Proceedings of the 2005 National Technical Meeting of the Institute of Navigation, 2005, pp. 276-281.

(Continued)

*Primary Examiner*—Shane Bomar
(74) *Attorney, Agent, or Firm*—Anthony R. Lambert

(57) ABSTRACT

To limit the growth of errors of an inertial navigation system for measurement-while-drilling, in-drilling alignment methods can be used. A pneumatics-based design of an apparatus for an in-drilling alignment method and its implementation downhole are described.

20 Claims, 11 Drawing Sheets

OTHER PUBLICATIONS

Goshen-Meskin, D., et al., "Observability Analysis of Piece-wise Constant Systems—Part 1: Theory", IEEE Transactions on Aerospace and Electronic Systems, 1992, vol. 28(4), pp. 1056-1067.

Goshen-Meskin, D., et al., "Observability Analysis of Piece-wise Constant Systems—Part 2: Application to Intertial . . . etc.", IEEE Transactions on Aerospace and Electronic Systems, 1992, vol. 28(4), pp. 1068-1075.

Ledroz, A., et al., "FOG-Based Navigation in Downhole Environment During Horizontal Drilling . . . etc.", IEEE Transactions on Instrumentation and Measurement, 2005, vol. 54(5), pp. 1997-2006.

Myeong-Jong, et al., "Nonlinear Robust Observer Design for Strapdown INS . . . etc.", IEEE Transacations on Aerospace and Electronic Systems, 2004, vol. 40(3), pp. 797-807.

Noureldin, A., et al., "Accuracy Limitations of FOG-Based Continuous Measurement . . . etc.", IEEE Transactions on Instrumentation and Measurement, 2002, vol. 51(6), 1177-1191.

Stoll, J.B., et a, "A New Application of a Fiber Optic Technique in Magnetic Borehole Logging", American Geophsyical Union Fall Meeting, 2002, pp. F1284.

* cited by examiner

IN-DRILLING ALIGNMENT

TECHNICAL FIELD

Inertial navigation systems, particularly as used in measurement-while-drilling.

BACKGROUND

Horizontal Directional Drilling (HDD) is considered a breakthrough in oil and gas exploration and extraction. The HDD method offers numerous advantages, including improved productivity for a longer time duration. Economic incentives to promote HDD are combined with improved safety and availability of useful insights into the drilling process for on-line and off-line analysis. Drilling itself is a very slow process. The penetration into the ground is in velocity range of about 100 m/min depending on the type of soil and rock formations encountered. This creates the ample opportunity for sophisticated downhole measurements, including temperatures, pressures, moisture, attitude, etc. These measurements are routinely transmitted to the surface, usually utilizing mud-pulse telemetry.

Proper and accurate navigation is critical for efficient and productive HDD. Current technology employed for directional drilling navigation is based on a combined magnetometer and accelerometer triad. Measurements of the Earth magnetic field and the specific force experienced by the bottom hole assembly (BHA) provide sufficient data to compute BHA position. The accuracy that can be achieved with these sensors is about ±0.5° for the inclination angle and about ±1° for the azimuth angle. The utilization of magnetically-based measurement systems makes this technique vulnerable to magnetic interferences due to the surrounding environment and the tools used in the drilling procedure. Ore deposits and metallic materials in the drilling vicinity, as well as geomagnetic influences deteriorate the ability of the magnetic triad to accurately compute attitude. In addition, there is a self-magnetic interference due to the drilling metallic parts. Methods used to reduce this self-interference include positioning the sensor triads about 50 feet away from the drill bit and utilizing non-magnetic drill collars above and below the surveying equipment. Such solutions are expensive, and they reduce the ability to accurately measure the motion experienced by the drill bit.

New approaches have been explored for improving directional navigation performance. Navigation based on inertial navigation systems (INS) has been widely utilized in advanced ground and air navigation, while its commercialization made it available for a larger variety of applications. However, this technique is also susceptible to bias and drift which preclude the materialization of its full benefits with respect to conventional magnetometer/accelerometer-based downhole navigation. For tactical-grade inertial measurement sensors (which are good candidates for drilling navigation), the gyro drift is in the range of 1-10 deg/hr and accelerometer bias is in the range of 100-1000 μg, which are not significantly better than the ones delivered by the presently used magnetometer-based drilling techniques. Thus, methods for navigational error reduction are pivotal for demonstrating the benefits of utilizing INS downhole.

Previous studies in air navigation discussed an in-flight alignment (IFA) process in air and sea-launched vehicles. Although low-cost inertial measurement units (IMU) were embedded in these vehicles, the utilization of IFA resulted in high accuracy, i.e., in good error handling. While it seems that IFA was less effective than stationary alignment, it was demonstrated that with proper maneuvers an improved alignment is achievable. The IFA proved itself during the calibration process for the error sources of the inertial sensors on a moving platform, in addition to successfully estimating the navigation errors. Thus, it became evident that IFA increased the observability of the INS states, which improved the estimability and the effectiveness of the Kalman filter used in the alignment process. These accelerations excite latent modes that contribute to the velocity error, which is generated by the INS being aligned. Comparing the INS velocity output to a reference velocity allows the estimation of the modes excited by these maneuvers.

In the context of directional drilling, an in-drilling alignment technique known as the zero velocity update procedure (ZUPT) is well known. This procedure involves halting the system and using the fact that the IMU is now known to be stationary to correct for velocity errors. The direction of gravity can also be used to determine the vertical direction. However the ZUPT cannot correct errors in the alignment of the IMU in the azimuthal direction. Procedures to correct the azimuthal alignment have been proposed by the inventor in an article, "On Azimuth Observability During INS Alignment in Horizontal Drilling" in 2005 and by Hansberry et al in US patent application 2005/0126022 (and Noureldin et al 2002/0133958). Both techniques measure the alignment of the IMU relative to the direction of the borehole axis; Hansberry (and Noureldin) rotate the IMU about an axis with a known orientation with respect to the borehole axis, and measure the alignment of the IMU with respect to this axis, while the inventor proposes moving the IMU along an axis parallel to the borehole axis and measuring the alignment of the IMU with respect to this axis, However the in the 2005 paper the inventor did not specify how the linear motion was to be achieved, and did not specify that outside measurements (ie, not by the IMU) of the acceleration could also be made in order to have a more accurate comparison with the IMU's measurements.

SUMMARY

In an embodiment, there is an apparatus for inertial navigation, comprising a piston contained within a cylinder and an inertial measurement unit. The inertial measurement unit is connected to the piston so that motion of the piston causes motion of the inertial measurement unit along an axis. The inertial measurement unit or a data-collecting device receiving data from the inertial measurement unit is configured to use measurements taken by the inertial measurement unit of the motion of the inertial measurement unit along the axis to correct or compensate for errors in the alignment of the inertial measurement unit.

In an embodiment there is an apparatus for inertial navigation, comprising an inertial measurement unit, a linear drive for the inertial measurement unit and a rotary drive for the inertial measurement unit. The inertial measurement unit is connected to the linear drive so that the linear drive causes motion of the inertial measurement unit along a linear axis. The inertial measurement unit is connected to the rotary drive so that the rotary drive causes rotation of the inertial measurement unit around a rotary axis. The inertial measurement unit or a data collecting device receiving data from the inertial measurement unit is configured to use measurements taken by the inertial measurement unit of the motion of the inertial measurement unit along the linear axis and the rotation of the in inertial measurement unit around the rotary axis to correct or compensate for errors in the alignment of the inertial measurement unit.

In an embodiment there is a method for correcting alignment errors in an inertial navigation system, comprising the steps of moving an inertial measurement unit along a linear axis while simultaneously rotating the inertial measurement unit around a rotary axis. The inertial measurement unit is used to take a measurement of the motion and rotation. The measurement of the motion and rotation is compared to an expected measurement of the motion and rotation. The difference between the measurement and the expected measurement is used to correct alignment errors.

In an embodiment there is a method of correcting or compensating for alignment errors in an inertial navigation system, comprising the steps of moving an inertial measurement unit along an axis during a time period. A magnetostrictive sensor is used to measure the position of the inertial measurement unit at plural times during the time period. The inertial measurement unit is used to measure acceleration during the time period. The measurements of the position by the magnetostrictive sensor are compared to the measurements of the acceleration by the inertial measurement unit to estimate errors in the alignment of the inertial measurement unit. The estimates of the errors in the alignment of the inertial measurement unit are used to correct or compensate for the errors.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Horizontal drilling features several advantages when it comes to oil exploration and production. First, it facilitates the accessibility of reservoirs in complex locations: under riverbeds, mountains and even cities. Secondly, if a particular reservoir is characterized by a large surface area, but is distributed over a thin horizontal layer, a horizontal well will yield a larger contact area with the reservoir and thus lead to a higher productivity and longevity when compared to vertical ones. Present applications of horizontal wells include intersecting of fractures; eliminating of coning problems in wells with gas and water coning problems; the improving of draining area per well in gas production, resulting in a reduction of the number of wells required to drain the reservoir; and providing larger reservoir contact area and enhancing injectivity of an injection well.

Figure 1:
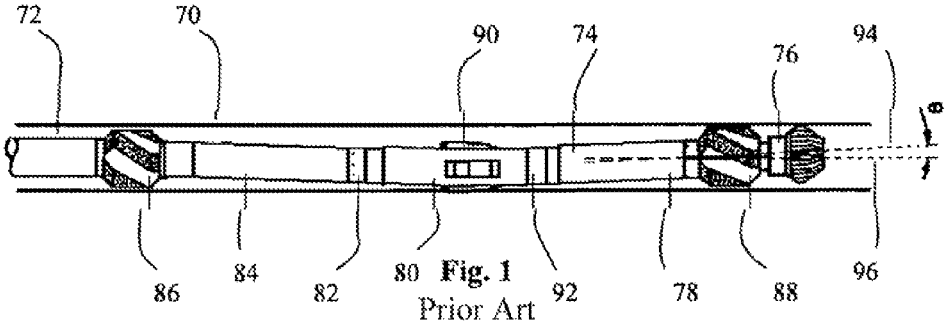
Fig. 1 Prior Art
FIG. 1 is a side view of a conventional drilling assembly.

The drilling of a directional (horizontal) well begins by drilling vertically from the surface to a kick-off point at a predetermined depth. Then, the well bore is deviated intentionally from the vertical at a controlled rate. To implement this complex drilling trajectory, measurement-while-drilling (MWD) equipment, steerable setup and surveying sensors must be incorporated within the drilling assembly. Referring to FIG. 1, the drilling assembly conventionally utilizes a diamond bit and a mud turbo-drill motor installed in front of a trajectory control sub, nonmagnetic drill collars which include magnetic surveying sensors, and a drill pipe. The drilling assembly, located in borehole 70, comprises a bottom hole assembly 74 at the end of drill string 72, the bottom hole assembly comprising in turn a drill bit 76, drilling motor 78, trajectory control sub 80, bypass sub 82, measurement-while-drilling tool 84 located in nonmagnetic collars, upper stabilizer 86 and lower stabilizer 88 for centering the drilling assembly in the borehole, and stabilizer blades 90. The bottom hole assembly, when changing direction, has an induced bend 92 to provide an angular offset ($\theta$) between the axis 94 of the drill bit and the center line 96.

The conventional measurement-while-drilling (MWD) surveying system presently utilizes three-axis accelerometers and three-axis magnetometers fixed in three mutually orthogonal directions. At a certain predetermined surveying stations, the drilling assembly is brought to rest. At that point, the body frame of the MWD surveying system, formed by the axes of the accelerometers and magnetometers, is an angular transformation of the reference (North-East-Vertical) frame. Since the position of the bottom-hole assembly (BHA) is known, the direction and magnitude of Earth's acceleration are known as well. By comparing the acceleration vector formed from the measurements of the three accelerometers with the known vector of Earth's gravitational acceleration in the reference frame, the pitch (θ) and row (Φ) can be calculated.

Then, the measurements from the magnetometers are combined with the calculated pitch and row to determine the azimuth angle (Ψ). The BHA trajectory is then computed by assuming a certain trajectory between the two successive stations.

Figure 2:
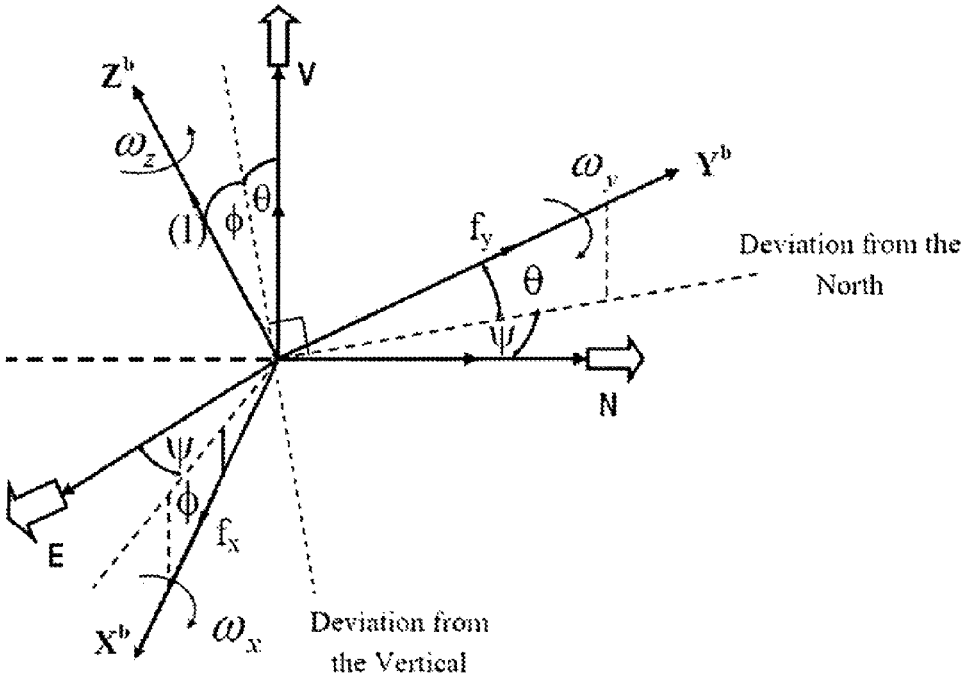
FIG. 2 is a diagram showing the pitch, row and azimuth angle.
Figure 11:
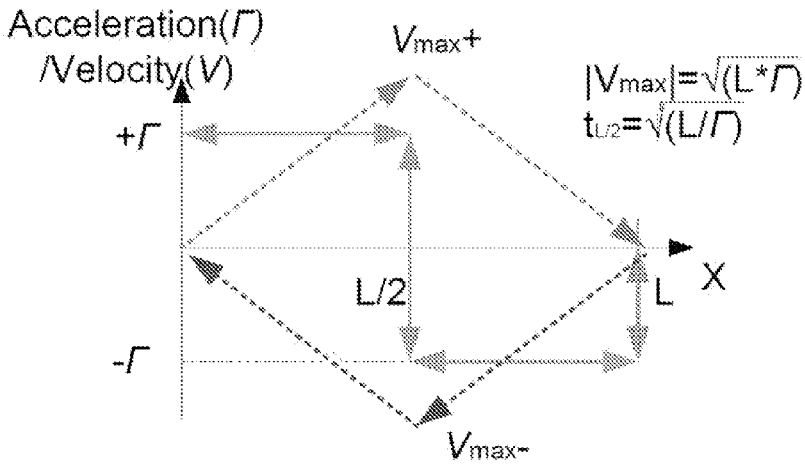
FIG. 11 is a schematic of the motion of an IMU in an in-drilling alignment process.

Referring to FIG. 2, $X^b$, $Y^b$ and $Z^b$ form the body frame, with its axes coinciding with the axes of the accelerometers and magnetometers. E, N, and V denote East, North, and Vertical and form the reference frame. The pitch (θ), the roll (Φ), and the azimuth (Ψ) describe the orientation of the MWD magneto-surveying system with respect to North, East, and Vertical directions. The measured accelerations along the axes x, y and z of the body frame are respectively $f_x$, $f_y$, and $f_z$. The measured angular rates in the body frame about the x, y and z axes are respectively $\omega_x$, $\omega_y$, and $\omega_z$ The in-drilling alignment (IDA) concept is based on inducing controlled motion patterns on the INS unit, which improves the observability of its system states. In an embodiment it is assumed that during the IDA the drilling process is stopped, which guarantees that the actual motion the INS is exposed to is due to the controlled induced motion only. A pre-designed downhole pipe of limited length L can be utilized for the IDA process. FIG. 11 introduces a simplified schematic description of the IDA concept. The induced motion is of a constant acceleration Γ until the INS capsule reaches the pipe center (L/2). Then the acceleration changes to −Γ, and the capsule reaches the end of the pipe (at length L), with zero velocity. The full line denotes the acceleration and the dotted lines mark the induced velocities along the pipe. The pattern of accelerations displayed here is only an example. Any induced acceleration, as long as the acceleration is known accurately enough, will work. In other embodiments, a sinusoidal-like induced acceleration may be used.

The filtering process of the alignment procedure requires sufficient IDA duration to ensure reaching steady state values. This duration requirement is achieved via back and forth motion in the pre-designed pipe. Unidirectional motion might require a significant pipe length rendering the IDA approach downhole unfeasible. Instead, the back and forth motion can be implemented by proper and timely switching of the induced acceleration. This exposes the INS to controlled accelerations for a sufficient duration, enabling convergence and proper alignment within a much shorter pipe length L. This approach is possible due to the fact that during the IDA process the polarity of the acceleration is irrelevant. With proper timing, it is possible to use different absolute acceleration values in the two opposite directions. These known acceleration values should be taken into account in the implementation and in the processing phases. The procedure can be repeated as needed, and as the drilling process allows, preferably in conjunction with the Zero Velocity Update (ZUPT). IDA performance in simulated induced accelerations clearly demonstrated that accelerations higher then 3 $m/s^2$ improved the performance and reduced considerably the needed IDA duration. The length of the pre-designed pipe depends on engineering limitations downhole. The actual IDA duration is not limited by the pipe length L and can be extended as needed by utilizing the back and forth motion.

The ability to provide the IDA with proper accurate controllable induced motion is important to a successful implementation of IDA. Some of the important specifications that are to be considered include:

Resolution—the smallest position increment that a motion system can detect. IMU position may be measured, for example, with a shaft encoder or a micropulse positioner.

Sensitivity—the minimum input that is able to produce a motion output.

Accuracy—the maximum expected difference between the actual and the desired position for a given input.

Absolute accuracy—the output of a system versus the commanded input.

On-axis accuracy—the position uncertainty after the linear errors are eliminated.

Precision—the range of deviations in output position that will occur for 95% of the motion motions from the same error free input.

Repeatability—the ability of a motion system to reliably achieve a commended position over many cases.

Backlash—the maximum magnitude of an input that produces no measurable output upon reversing direction. It can be a result of poor gear coupling.

Hysteresis—the difference in the absolute position of an object for a given commanded input when approached from opposite directions.

Tilt and wobble—the angular portion of off-axis error. It is the deviation between ideal straight line motion in a translation stage. Tilt and wobble have three orthogonal component (roll, pitch and yaw).

Error—the difference between the obtained performance and the desired one.

Figure 17:
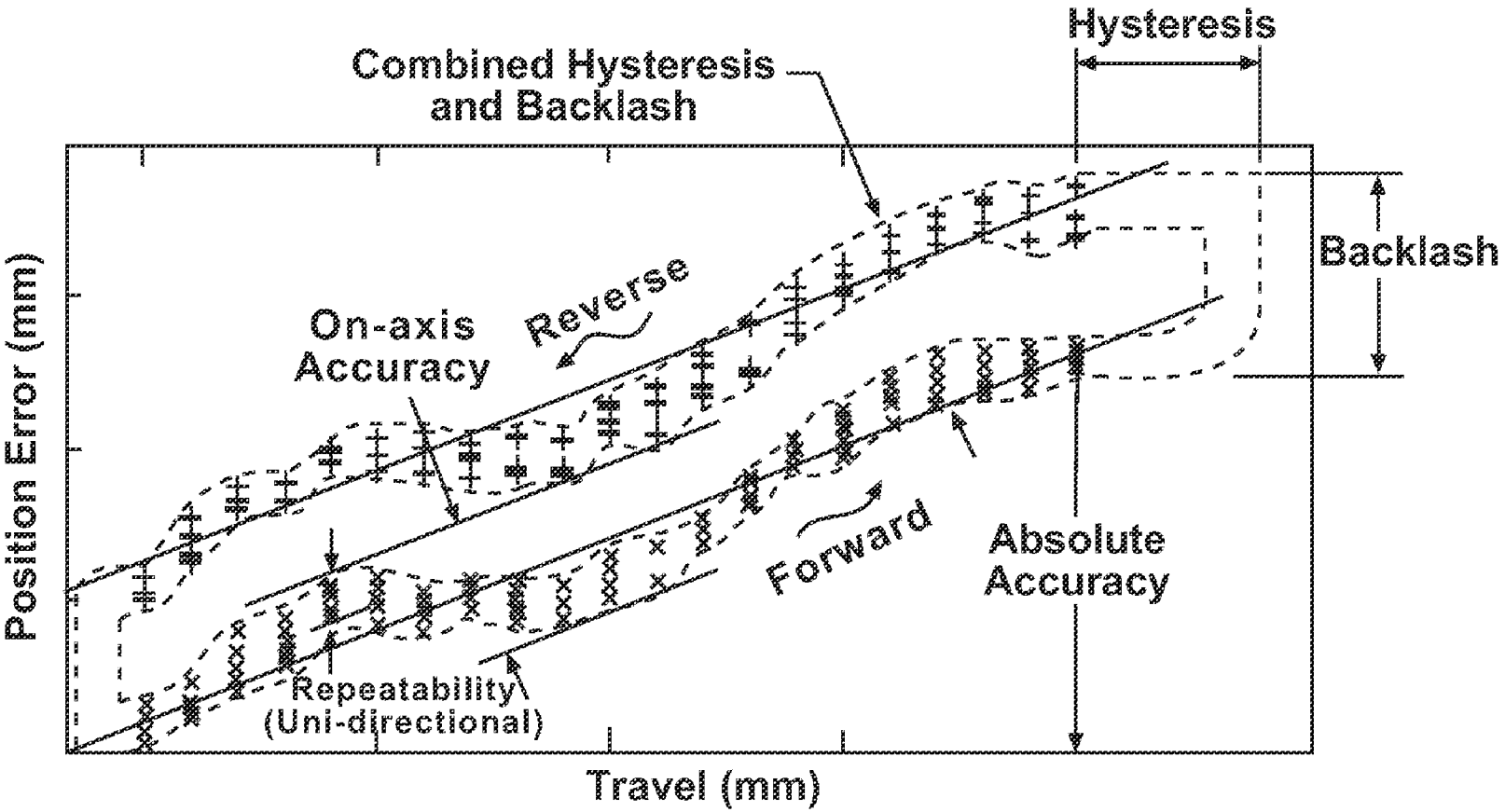
FIG. 17 is a graph illustrating several possible characteristics of measurement errors.

Some of these parameters are described in the FIG. 17.

The IDA concept involves with motion inducing process which requires enough power to allow it. Using the basic interrelations of power, force and work it can be easily derived that for constant acceleration a and an IDA duration of t seconds the power required is given according to:

$$P=m\cdot a^2\cdot t$$

where m is the mass of the inertial unit which is exposed to the IDA.

Figure 18:
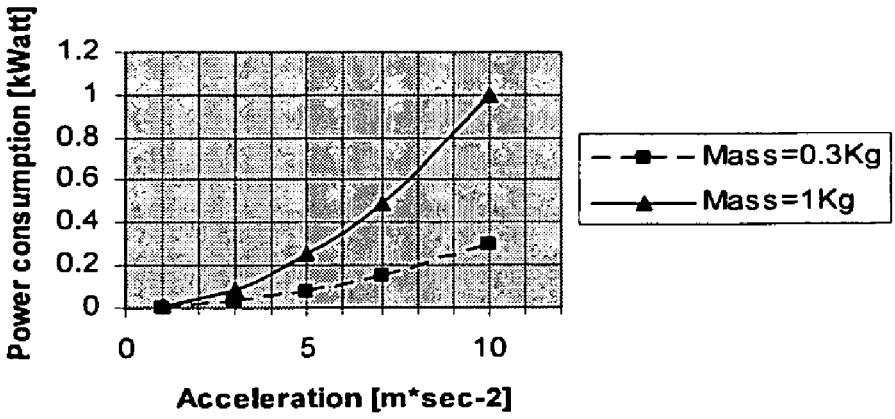
FIG. 18 is a chart showing peak power consumption required to accelerate a mass for ten seconds, for different values of mass and acceleration.

The power can be evaluated for some cases. For an IDA duration of 10 seconds and assuming a mass of 1 kg, for an acceleration of 10 $m\cdot sec^{-2}$ the power required is 1 kW. For an acceleration 3 $m\cdot sec^{-2}$ the required power is 90 W. Since the transformation of energy is involved with losses, higher energy sources are needed to insure the required motion. Also, there are additional power consumers related to the IDA process like to the inertial navigation unit etc. FIG. 18 shows the net power needed for various linear acceleration with two cases of weights loads.

Modern oil drilling usually transmits the rotary movement and the necessary torque to the drill bit directly from a motor. It is usually powered electrically or hydraulically. Typical power consumption of the drilling is 100-250 kW. The IDA process is due to take place when the drilling motor is idle which allows allocating the power used for the drilling towards the IDA process.

Figure 19:
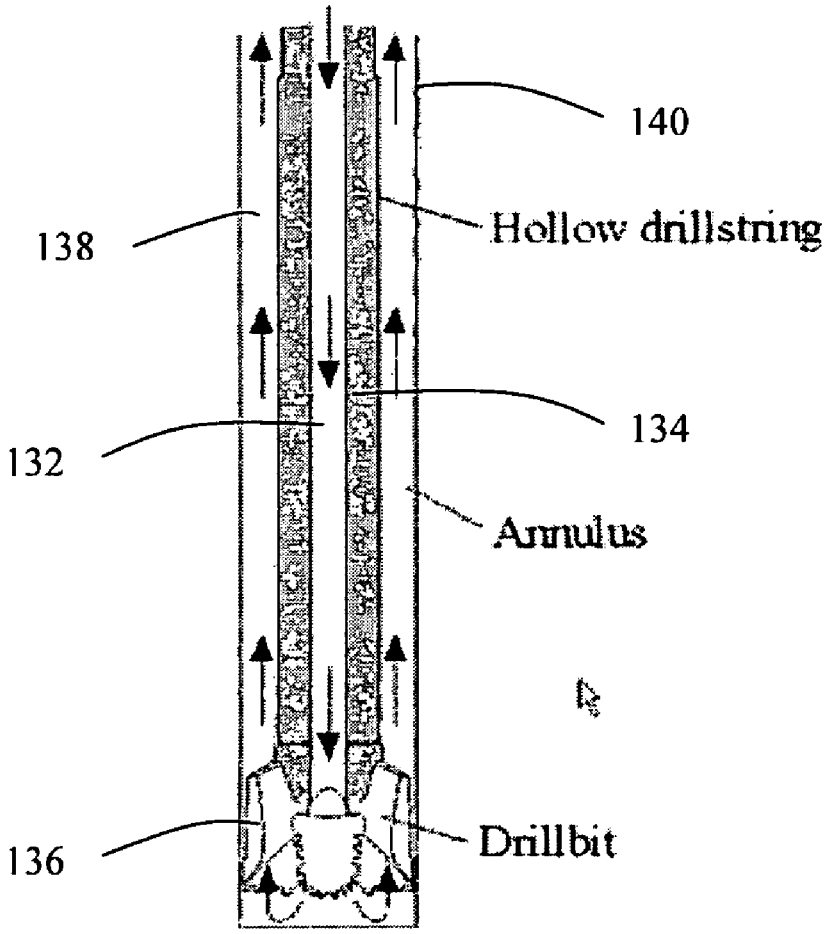
FIG. 19 is an illustration of the mud flow down the drill string and back up the annulus.

Another approach is to utilize the mud flow utilized in the drilling process to extract energy. FIG. 19 shows in general the flow of the drilling mud within the drilling process.

Drilling mud is used to control subsurface pressures, lubricate the drill bit, stabilize the well bore, and carry the cuttings to the surface, among other functions. Mud is pumped from the surface through the interior 132 of the hollow drill string 134, exits through nozzles in the drill bit 136, and returns to the surface through the annular space 138 between the drill string 134 and the walls 140 of the hole. As the drill bit grinds rocks into drill cuttings, these cuttings become entrained in the mud flow and are carried to the surface.

Energy extraction from the mud flow can be implemented using turbines. A turbine is a rotary engine that extracts energy from a fluid flow. The simplest turbines have one moving part, a rotor-blade assembly. Moving fluid acts on the blades to spin them and impart energy to the rotor.

A working fluid contains potential energy (pressure head) and kinetic energy (velocity head). The fluid may be compressible or non-compressible. Several physical principles are employed by turbines to collect this energy. The principle of a power turbine is to direct the incoming water tangentially by stationary vanes, and then to have it pass to the moving runner where it exerts forces on the runner vanes while its pressure decreases from the input head to zero. Since the pressure varies, the turbine must flow full. The exit velocity is not zero, but most of the kinetic energy can be recovered in a draft tube where the water is decelerated. For example, A cubic metre of water can give 9800 J of mechanical energy for every metre it descends, and a flow of a cubic metre per second in a fall of 1 m can provide 9800 W, or 13 hp. The efficiency of hydraulic machines can be made close to 1, so that all this energy is available, and it can be converted to electrical energy with an efficiency of over 95%.

The IDA process should support data acquisition either for real time IDA processing and/or for off-line analysis. This might require the utilization of a short-range wireless data support for transferring raw or pre-processed data from the navigation unit in the IDA phase to a control analysis unit located in the drill string to process the data and extract the proper improved alignment data achieved.

The data handling should process the information stream provided by the six sensors on board the navigation unit (the accelerometer triad and the gyro triad). The raw data rate is of few hundred readings per second (in a unit experimented with, the LN 200, it is 360 readings/second per sensor). In another embodiment, a rate of 400 readings/second is used. The data rate is not specific to the apparatus, but to the inertial measurement unit that is utilized. The apparatus accommodates various inertial measurement units. Each sensor sample is formed by two bytes, which means that the net raw data stream (without the additional bits needed for synchronizing and managing the data stream) is about 4 Kbytes/sec.

Transferring the readings from the sensors via wires during the IDA motion might limit possible motion patterns. A possible solution is a short-range wireless link. The maturity of the wireless communication market, and specifically the maturity of Wi-Fi wireless links for a variety of applications look promising. The links currently operate in the unlicensed 2.4 GHz and 5 GHz frequency bands. The 2.4 GHz band (802.11b) offers a data rate of 11 mega bits per second (Mbps), utilizes Direct Sequence Spread Spectrum (DSSS), and has a range of about 300 feet. The 5 GHz band (802.11a) offers a data rate of 54 Mbps, utilizes Frequency Hopping Spread Spectrum (FHSS), and has a range of about 150 feet.

Figure 3:
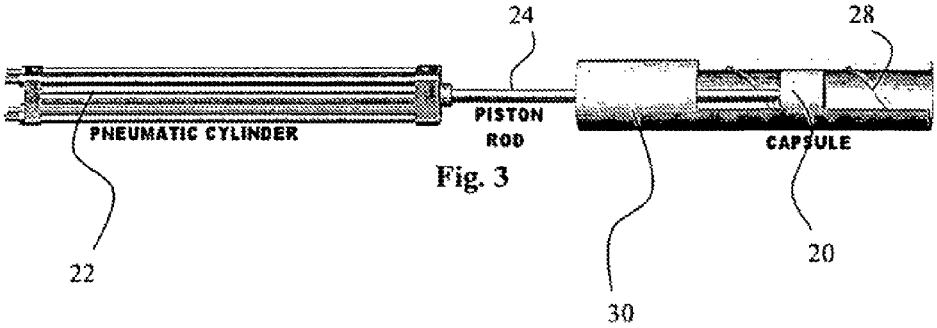
FIG. 3 is a partially cutaway side view of an embodiment of the in-drilling alignment apparatus.
Figure 4:
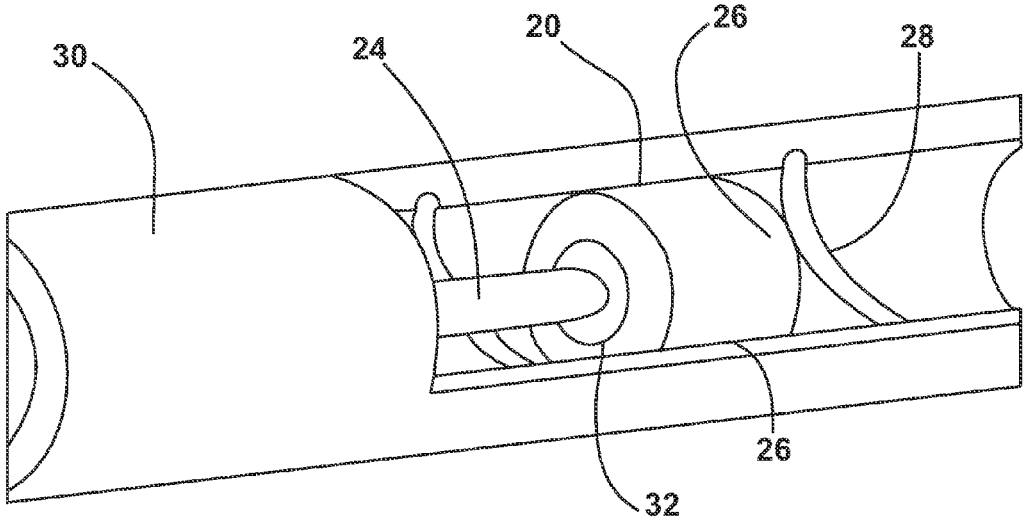
FIG. 4 is a partially cutaway perspective view of the capsule and pipe of the embodiment of FIG. 3.

In one embodiment, a pneumatic-based solution is proposed for inducing a motion of the IMU in the horizontal plane while the bottom-hole assembly is at rest. Referring to FIG. 3 and FIG. 4, a compact cylindrical capsule 20 containing an IMU, an RF transmitter, and a small battery to power the IMU and the transmitter, is attached to the end of a piston rod 24 of a pneumatic cylinder 22 via a bearing 32. The bearing allows the capsule to rotate freely around the cylinder's rod. By correctly regulating the pressure on each side of the piston, desired linear accelerations of the piston rod-IMU assembly can be obtained. In other embodiments, hydraulics may be used as well as or instead of pneumatics. Power from the mud flow may be generated to move the IMU.

In one embodiment, this linear motion can be further employed for inducing an angular motion of the IMU about the axis of one of its gyroscopes. On the exterior surface of the cylindrical capsule, around its axis, ball bearings 26 are positioned in a helical pattern. Similar helical thread 28 is machined on the inner side of a pipe 30, to allow the bearings 26 on the capsule to smoothly traverse along it. Thus, any linear motion induced on the capsule by the pneumatic cylinder will simultaneously cause an angular motion. If the linear acceleration of the IMU-containing capsule and the angular step of the helical thread are accurately known, then the angular acceleration of the capsule can be calculated easily. This in turn can be integrated to yield the angular rotation rate of the capsule. The rotational motion described here may be induced by other means. For example, in another embodiment, a pneumatic cylinder may be used to induce controlled axial rotational motion together with the linear motion.

In order to have more accurate data for the motion of the IMU to compare with the measurements by the IMU of its own motion, the position of the IMU can also be measured by, for example, a magnetostrictive position sensor.

Figure 6:
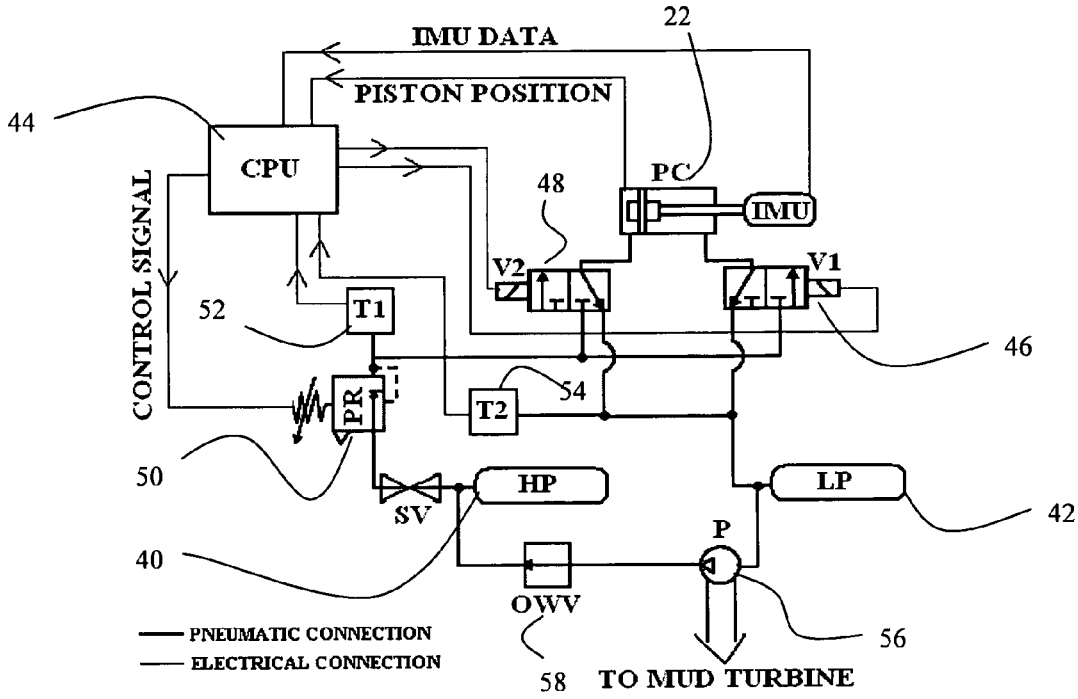
FIG. 6 is a schematic showing the control system of an embodiment of a pneumatic system for an in-drilling alignment apparatus.

The following simplified setup of a fluid drive is proposed for inducing and controlling the motion of the IMU (shown in FIG. 6).

Initially, the system comprises a high (HP) air tank 40 and a low (LP) air tank 42. The Central Processing Unit (CPU) 44 can independently control the two solenoid valves (V1) 46 and (V2) 48 through which the pneumatic cylinder 22 is connected to the rest of the pneumatic system. By feeding the appropriate signals to the two valves, the right chamber of the cylinder may be connected to the low-pressurized air tank, and the left to the highly-pressurized (HP) air tank via the electronic pressure regulator (PR) 50. Then the two electric pressure transducers (T1) 52 and (T2) 54 inform the CPU of the air pressure in each chamber of the cylinder. Based on this information, the CPU calculates the necessary regulated pressure and controls the proportional regulator (PR). Once a pressure differential is established across the piston, a linear acceleration on the piston-IMU assembly is induced. A measurement of the piston's position is supplied to the CPU by the magnetostrictive effect-based measuring unit. The three acceleration components and angular rates measured by the IMU are also passed to the CPU where, together with the position of the piston, the data is processed mathematically to align the IMU.

Once the piston of the pneumatic cylinder is near the end of its stroke, the CPU reverses the valves (V1 and V2) and an opposite acceleration is induced. Cushions are provided on both sides of the piston to reduce the severity of the impact with the cylinder's walls.

Eventually, the pressures in the two air tanks will equalize, limiting the number of piston cycles and thus the number of alignment data points. To restart the system, the mud-powered air pump 56 is turned on to pressurize the HP air tank to its initial high pressure. This in turn will bring the LP tank back to its original low pressure. Air is pumped from the LP tank to the HP tank through a special one-way air valve (OWV) 58 that will prevent air from leaking back to the LP tank through the pump P. This resetting procedure is only possible when there is mud flow. Thus, it will be performed during the drilling process. The IDA process preferrably takes place when the bottom-hole assembly is at rest.

Since the IMU is constantly in motion during the IDA process, wiring the IMU will be impractical and will result in constant stress applied to the wires. To eliminate such problems, an RF link is proposed between the IMU and a local receiving module mounted on the exterior surface of the tube through which the IMU is accelerated. Thus, the three components of acceleration and angular rate measured by the IMU are sent to a local RF receiving module and then, together with the cylinder's piston position are wired to the CPU. There, the data is mathematically processed to determine the position of the BHA in the horizontal North-East frame. It is then sent to the surface, for example, by the conventional method of mud pulse telemetry. In other embodiments, the downhole information may be transmitted to surface using electromagnetism or other methods known in the drilling industry.

Figure 5:
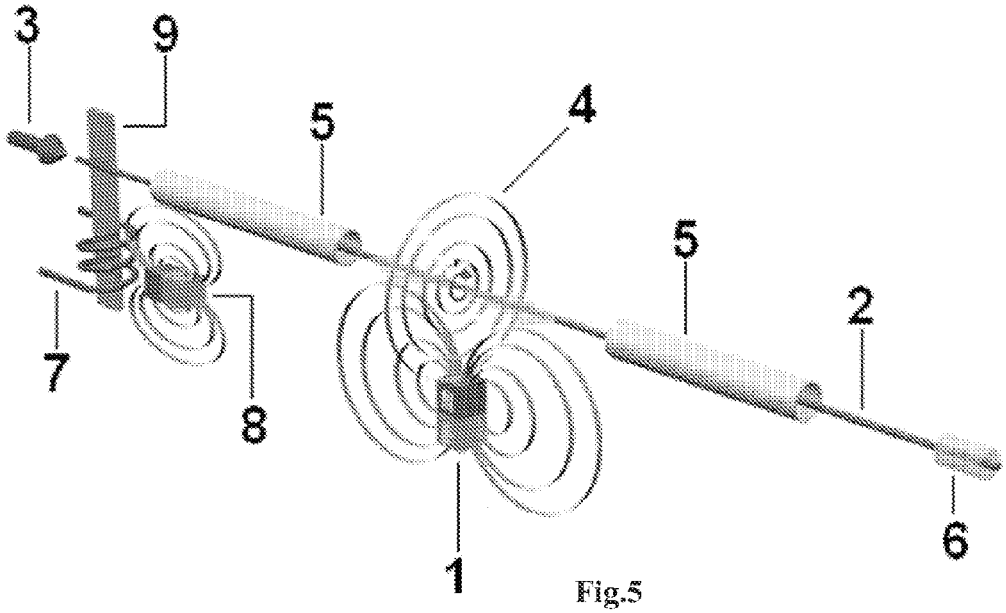
FIG. 5 is a schematic perspective view of a magnetostrictive sensor system.

The principle of the magnetostrictive effect may be employed for monitoring the position of the piston in the pneumatic cylinder. For this purpose, as shown in FIG. 5, the piston is equipped with tiny magnets, and a special piston position-sensing unit is installed along the cylinder.

The unit consists of a "waveguide" 2 made of a special nickel-alloy tube through which runs a copper wire, surrounded by protective casing 5. The initiation of a measurement is denoted by a short electric pulse 3 through this wire, which sets up a circular magnetic field 4 around it. At the point along the "waveguide" 2 where the produced field intersects the perpendicular magnetic field due to the magnets 1 located in the piston of a pneumatic cylinder, an elastic deformation of the nickel-alloy tube is caused according to the magnetostrictive effect. The component of the deformation wave that traverses the "waveguide" toward its back end is dampened by dampener 6, while the component that arrives at the signal converter is transmitted along a strip 9 and transformed into an electric pulse by mechanical wave detecting coil 7 located in a magnetic field provided by magnet 8. Since the travel time for the pulse is directly proportional to the position of the magnetic piston, by determining the elapsed time between the initiating pulse and received pulse, the piston's position can be estimated with high accuracy in the order of 5 μm.

Once the position of the piston is accurately known, a differentiation yields its velocity and acceleration. However, since the IMU capsule is affixed to the piston rod of the pneumatic cylinder, its linear component of motion is completely defined. Moreover, the angular rate of the IMU around the axis of the pneumatic cylinder can be calculated according to:

$$\omega = v \cdot \lambda \tag{1}$$

where (ω) is the angular speed, (v) is the linear speed and (λ) is the angular step of the machined helical thread.

To model the pneumatic system extensively, first a model of the pneumatic cylinder for its specific application will be derived. Throughout the entire model, all pneumatic processes are assumed to be adiabatic and the fluid (gas) is treated ideally. Such assumptions still provide excellent results for similar applications, while greatly simplifying the model.

Figure 7:
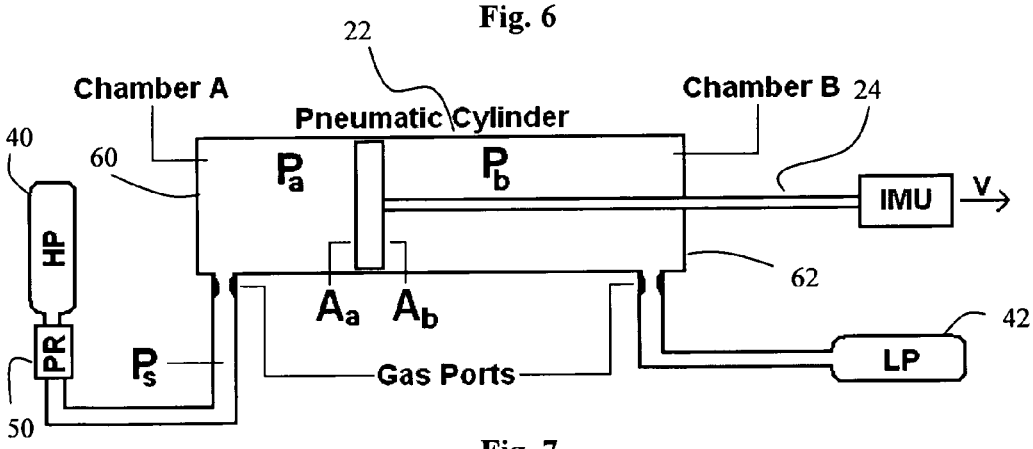
FIG. 7 is a schematic showing an embodiment of a pneumatic system for an in-drilling alignment apparatus.

Referring to FIG. 7, let the cylinder be divided into two separate chambers A 60 and B 62. Also, assume that the piston is moving to the right with speed v. The pressure change in chamber A is described by:

$$\dot{P}_a = \left(\dot{m}_a - \frac{P_a A_a}{RT_s}\dot{x}\right)\frac{c_p R T_s}{c_v\left(V_{da} + \left(\frac{x_1}{2} + x\right)A_a\right)} \tag{2}$$

where $m_a$ and $P_a$ are the mass of gas and pressure in chamber A respectively, and $A_a$ is the area of the piston's surface enclosing chamber A.

The position of the piston in the cylinder is denoted by x, while $x_1$ denotes the cylinder's stroke; Vda is the dead volume entitled to chamber A (tubing volume and unused cylinder volume). The temperature of the supplied gas is $T_s$, and $c_p$ and $c_v$ stand for the constant pressure and volume specific heats of the gas respectively; R is the gas constant. The rate of change of mass of gas in chamber A is given by:

$$\dot{m}_a = \frac{c_q a P_s}{\sqrt{T_s}}\sqrt{\frac{2.8}{R(\gamma-1)}\left[\left(\frac{P_a}{P_s}\right)^{\frac{2}{\gamma}} - \left(\frac{P_a}{P_s}\right)^{\frac{\gamma+1}{\gamma}}\right]} \tag{3}$$

In (3), $c_q$ is the flow discharge coefficient of the pneumatic cylinder's inlet, a is the area of the inlet; and γ is the specific heat ratio. Similarly, the pressure change model for chamber B is:

$$\dot{P}_b = \left(\dot{m}_b + \frac{P_b A_b}{RT_s}\dot{x}\right)\frac{c_p R T_s}{c_v\left(V_{db} + \left(\frac{x_1}{2} - x\right)A_b\right)} \tag{4}$$

where the variables correspond to the ones defined in Eq. (2), but applicable to chamber B. The rate of change of gas mass in chamber B is quantified similarly:

$$\dot{m}_b = \frac{c_q a P_b}{\sqrt{T_b}}\sqrt{\frac{2.8}{R(\gamma-1)}\left[\left(\frac{P_{ex}}{P_b}\right)^{\frac{2}{\gamma}} - \left(\frac{P_{ex}}{P_b}\right)^{\frac{\gamma+1}{\gamma}}\right]} \tag{5}$$

where, $T_b$ is the temperature of chamber B, and $P_{ex}$ is the exhaust pressure (pressure of LP tank).

Furthermore, the supplied pressure $P_s$ that appears in Eq. (3) is the regulated pressure that comes from the proportional pressure regulator PR (FIG. 6). However, since $P_s$ is estimated by the CPU based only on the readings of the two pressure transducers T1 and T2 (shown in FIG. 6), it can be concluded that:

$$P_s = f(T_1, T_2) \tag{6}$$

Additionally, the motion of the IMU-piston assembly can be modeled by:

$$M(\ddot{x}+g') + D\dot{x} = P_a A_a - P_b A_b + \hat{x} k \Delta \tag{7}$$

where M is the total mass of the IMU-containing capsule, piston and rod; x is the position of the piston inside the cylinder; D is some constant dependant on the materials used and the construction of the apparatus; g' is the component of Earth's acceleration parallel to the direction of induced motion on the IMU; k is the elasticity constant for the front and rear bumpers of the piston, and Δ is the change in length of the bumper. Equations 1-7 now completely define the pneumatic system for inducing a linear and angular motion on the IMU.

In order to implement the proposed design, the following materials and components were sourced.

Pneumatic Cylinder (Cat. No. 2.00CJ2MABUS14AC20, Parker Pneumatics, Calgary, Alberta) with magnetostrictive linear position sensor (Cat. No. BTL5M1M0500RSU022KA02, Parker Pneumatics, Calgary, Alberta)
Cylinder Bore: 50.8 mm
Cylinder Stroke: 508 mm
Both sides cushioned magnetic piston:
Simulated Elasticity Constant(k): 20000 N/m
Simulated Cushion Thickness: 5 mm
Inlet/Outlet Air Ports
Flow Discharge Coefficient: 0.9
Port Cross-Section Area: $1.96*10^{-5}$ $m^2$
Dead Volumes
Chamber A/B: $1.96*10^{-3}$ $m^3$ Electronic Proportional Pressure Regulator (Cat. No. PAR-15 W2154B179B, Parker Pneumatics, Calgary, Alberta)
Analog Voltage Control (0-10V)
Simulated Pressure Regulating Function:
Arguments (High pressure chamber (HP), Low pressure chamber (LP))
{
if (HP-LP<2000 Pa AND LP+20 kPa<pressure of high-pressure tank)
{
Regulated Pressure=LP+20 kPa
}
else {Regulated Pressure=HP}
}

Figure 8:
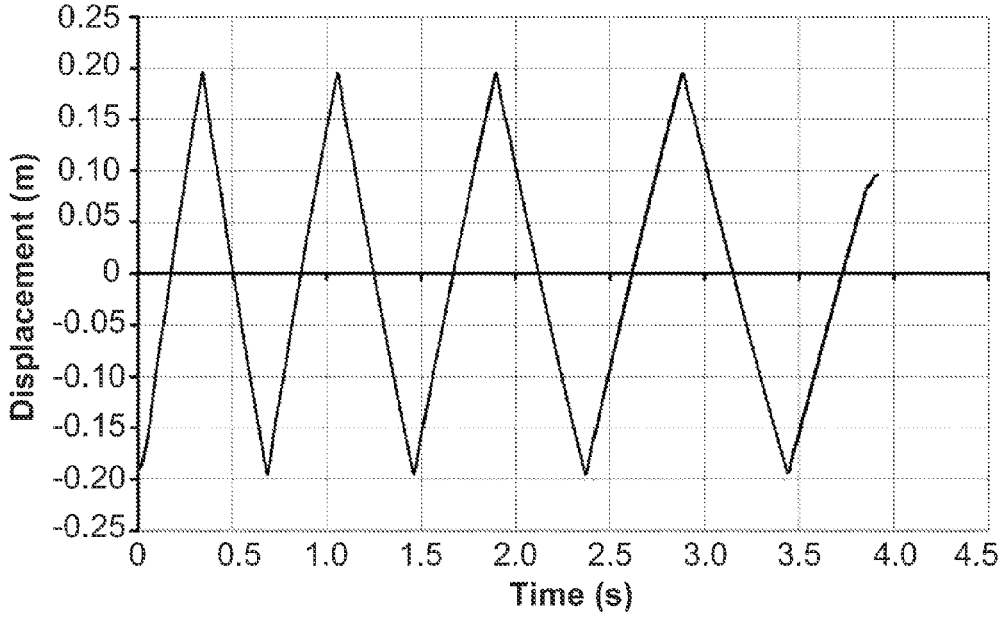
FIG. 8 is a graph showing a simulated displacement over time of the piston in an embodiment of an in-drilling alignment apparatus.

Micro-electromechanical (MEM) Inertial Measurement Unit (MEMSense 2693D, Rapid City, S. Dak.)
Accelerometers (A50)
Dynamic Range: ±50 g
Drift: 0.3 g
Gyroscopes (−120° C.050)
Dynamic Range: ±1200°/s
Magnetometers (not utilized in the proposed design)
Dynamic Rang: ±1.9 G
Drift: 2700 ppm/° C.
Absolute Maximum Ratings:
Operation Temperature: −40° C. to 85° C.
Acceleration (Shock): 2000 g for 0.5 ms According to the derived model of the pneumatic system and the outlined parameters of each component, a C++ simulation (Bloodshed Dev C++, Bloodshed Software, available on the internet) revealed the position of the piston in the pneumatic cylinder as a function of time. The displacement relative to the middle of the stroke of the cylinder is shown in FIG. 8.

Figure 9:
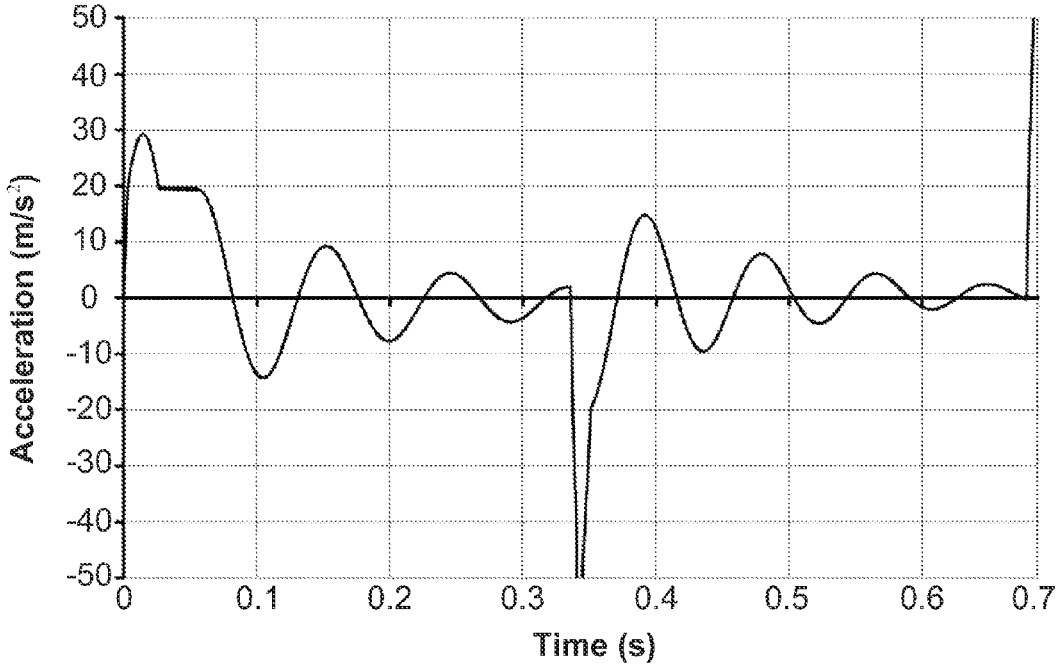
FIG. 9 is a graph showing a simulated acceleration over time of the piston in an embodiment of an in-drilling alignment apparatus.

A tank initially pressurized to ten atmospheres will allow the completion of four full cycles in less than 3.5 seconds. The piston can be then brought to rest during the fifth cycle and locked in place by completely closing the inlet and outlet ports of the cylinder. The acceleration of the piston-IMU assembly was also simulated over the duration of a full cycle (shown in FIG. 9).

The constantly changing acceleration of the piston (FIG. 9) is due to the specifically implemented function in the simulation, relating the two electronic pressure transducer outputs to the regulated pressure adjusted by the proportional pressure regulator. For a sampling rate of 400 Hz, the time intervals of 0 to 0.3 seconds and 0.35 to 0.6 seconds will be proper choices for observations source. The data obtained in these time intervals can then be utilized in aligning the IMU sensors. However, a more gradually changing acceleration of the piston is desired in order to align the IMU more accurately. The acceleration peaks at 0.34 s and 0.68 s correspond to the accelerations experienced by the IMU-piston assembly when the piston's bumper collides with the cylinder's wall.

Figure 10:
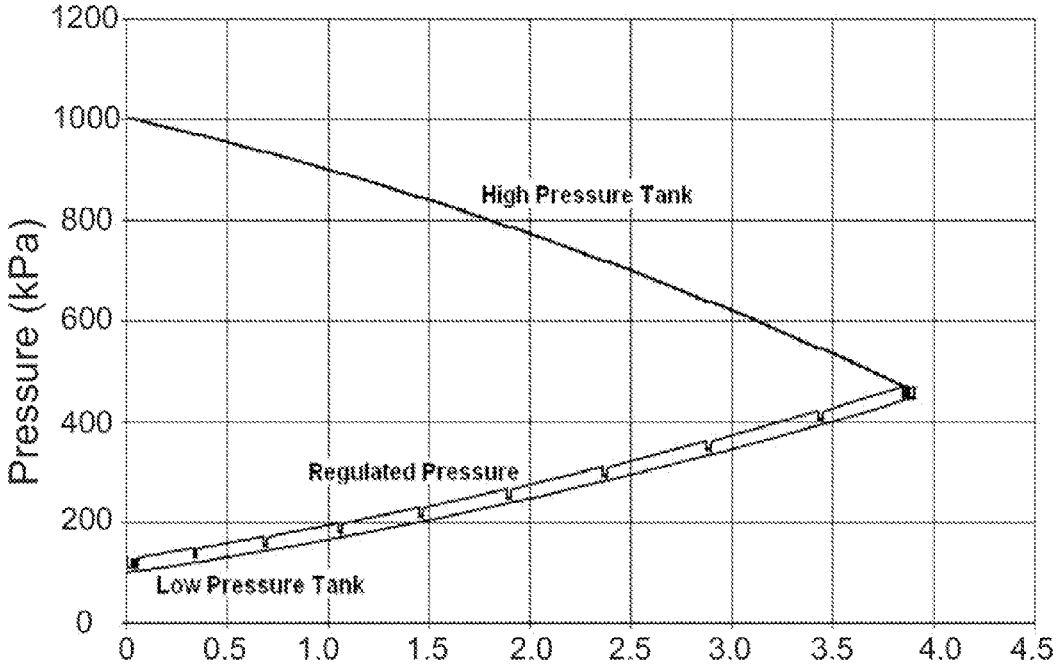
FIG. 10 is a graph showing a simulated pressure over time of the air in the high and low pressure tanks, and the air exiting a pressure regulator, in an embodiment of an in-drilling alignment apparatus.

The pressure in each tank as a function of time during the entire induced motion process has also been explored. As shown in FIG. 10, after 3.8 s (for the outlined system parameters), the pressures in the two tanks will equalize, and the induced motion will come to an end. At this point, the mud-powered air pump is turned on to pressurize the high-pressure tank to its initial value. Although the currently implemented pressure regulating function will yield economical use of the fluid (air), a function that will provide more gradual accelerations of the piston is desired.

Once data are obtained for the motion of the IMU during the in-drilling alignment procedure, corrections to errors in the IMU's alignment, position and velocity can be obtained using the method described as follows.

Observability analysis is an important tool for assessing system performance and for designing an optimal filter. In 1963, Kalman suggested to divide a system into observable and non-observable sub-systems, and to estimate the state vector for the former. The advantage of this approach is the ability to construct an estimator for the observable sub-system of lower order then the original one. Moreover, this technique provides the preliminary knowledge of the states that are going to be adequately estimated, and the measurements that have to be added to make the entire system observable. However, a unique solution for determining the observable states and for finding added measurements that would improve the system observability is not always possible.

An important phase in the system observability evaluation process is the construction of the observable matrix. Knowing this matrix makes it possible to divide the dynamic matrix of the system into observable and non-observable sub-matrices. Following this separation, the added measurements that increase the system observability can be decided in an effective manner.

Observability evaluation allows tracking changes in the observability status of the states depending on changes in the dynamic system matrix. Further, it facilitates future definition of 'optimal', or 'better' trajectories as the application and relevant scenarios allow. Not considering the process and measurement noises, a general continuous linear system in the state-space domain is defined by:

$$\frac{d\bar{x}(t)}{dt} = A(t)\cdot\bar{x}(t), \quad \bar{x}(t_0) = \bar{x}_0 \quad \bar{z}(t) = H(t)\cdot\bar{x}(t) \tag{8}$$

where $\bar{x}(t)$—state vector of order n;

$\bar{z}(t)$—measurement vector of order m;

A(t)—dynamic matrix of order n×n;

H(t)—measurement matrix of order m×n.

The time varying solution of the measurement $\bar{z}(t)$ for $t \geqq t_0$ is:

$$\bar{z}(t)=H(t)\cdot\Phi(t,t_0)\cdot\bar{x}(t_0) \tag{9}$$

where $\Phi(t,t_0)$ is the transition matrix of order n×n. When the dynamic matrix of the system A(t) is time-invariant, the transition matrix $\Phi(t,t_0)$ turns out to be:

$$\Phi(t,t_0)=\exp[A(t-t_0)] \tag{10}$$

and, the solution for the state vector is $$\bar{x}(t,t_0)=\exp[A(t-t_0)]\cdot\bar{x}(t_0) \tag{11}$$

n discrete time, a system can be described by the following set of equations:

$$\bar{x}(k+1)=F(k+1,k)\cdot\bar{x}(k)x(k=0)=x_0$$

$$\bar{z}(k)=H(k)\cdot\bar{x}(k)k=0,1,2,3 \tag{12}$$

where x(k)—state variables vector of order n;

z(k)—measurement vector of order m;

F(k+1, k)—state transition matrix of order n×n between times $t_k$ and $t_{k+1}$;

H(k)—measurement matrix of order m×n.

The time varying solution for the measurement z(k) for $k=k_1\geqq 1$ is:

$$z(k_1)=H(k_1)\cdot F(k_1,k_1-1)\cdot\ldots\cdot F(2,1)\cdot F(1,0)\cdot x_0 \tag{13}$$

and if the state transition matrix is constant and equals F, then the transition matrix $F(k_1,0)$ is given as $F(k_1,0)=F^{k_1}$. Since observability does not depend on the input excitation, it is sufficient to evaluate the behavior of the homogenous system:

$$x(k+1)=F\cdot x(k)$$

$$z(k)=H\cdot x(k) \tag{14}$$

which means that:

$$\begin{aligned} z(0) &= H\cdot x(0) \\ z(1) &= H\cdot x(1) = H\cdot F\cdot x(0) \\ &\vdots \\ z(n) &= H\cdot F^{n-1}\cdot x(0) \end{aligned} \tag{15}$$

This set of equations can be rewritten in a matrix form:

$$Z=Q\cdot x(0) \tag{16}$$

where $$Q\equiv\begin{bmatrix} H \\ H\cdot F \\ \vdots \\ H\cdot F^{n-1} \end{bmatrix}, Z\equiv\begin{bmatrix} z(0) \\ z(1) \\ \vdots \\ z(n-1) \end{bmatrix} \tag{17}$$

and Q can be written in its transposed form as:

$$Q^T\equiv[\,H^T\ \vdots\ (H\cdot F)^T\ \vdots\ \ldots\ \vdots\ (H\cdot F^{n-1})^T\,] \tag{18}$$

This discrete linear system is considered observable if $x_0$ can be calculated from the observation series {z(0), z(1), z(2), . . . , z(n−1)} for some finite n. If $x_0$ can be calculated for every starting time, the system is completely observable. This complete observability is achieved if the rank of the matrix Q is n. If it is less then n, then there are unobservable states.

So, a time-invariant linear system is observable, if the rank of its observation matrix, Q, is n. In this case the initial state vector, $\bar{x}_1$, can be determined based on the observation vector $\bar{z}(t)$ for $t\geqq t_0$. If the rank of the observation matrix is less then n, the system is not observable and it is not possible to determine all the components of the initial state vector.

The aims of the observability test are:

I. Determining the states which can be calculated (i.e. the states which are observable);

II. Finding those state components, the measurement of which will make the entire system observable;

III. Defining the observable sub-system dynamics, which will provide the ability of using a lower order estimator.

Assume that the rank of the observability matrix Q is s (s<n). This means that the dimension of the observable sub-space of the system is s and the dimension of the un-observable sub-space is p (p=n−s). Therefore, in the matrix Q there are s independent rows that define a sub-space of dimension s. With elementary operations on Q rows, denoted by the transformation V, a new base for this sub-space is constructed:

$$V\cdot Q=U=\begin{bmatrix} U_{OBS} \\ 0_{((n-s)\times n)} \end{bmatrix} \tag{19}$$

$$U_{OBS}=[I_{s\times s}\mid P_{s\times p}]$$

where the reduced observation matrix $U_{OBS}$ is of the order s×n.

$I_{s\times s}$-stands for a unity matrix of rank s and $P_{s\times p}$ stands for a matrix of size s×p.

Inertial navigation systems solve Newton's force equations by utilizing measurements of the specific forces (i.e. accelerations) coordinated in a frame whose orientation with respect to an Earth-centered inertial frame is determined by the gyroscope measurements. For terrestrial navigation the equation in terms of ground velocity in an arbitrary rotating frame r is:

$$\partial\bar{V}/\partial t|_r+(\omega_{ie}+\omega_{ir})\times\bar{V}-g=f \tag{20}$$

where $\bar{V}$ is the velocity with respect to Earth, f is the specific force exerted on the rotating frame, g is Earth gravity, $\omega_{ie}$ is the Earth rotation rate, $\omega_{ir}$ is the angular velocity of the r frame with respect to an Earth-centered inertial frame, and $\partial\bar{V}/\partial t|_r$ is the velocity derivative in a rotating frame r.

Eq. (20) offers a reasonable approximation of the INS velocity error propagation for small misalignment errors:

$$\delta\bar{V}=-\bar{\phi}\times\bar{a} \tag{21}$$

where $\delta\bar{V}$, $\bar{a}$ and $\bar{\phi}$ represent the velocity time derivative error, sensed acceleration and orientation misalignment angle vectors, respectively. This equation is a good approximation of the INS velocity error propagation due to misalignment. If we assume that $\bar{\phi}$ is a vector of constant angles, an integration of the equation reveals that the horizontal components of the velocity error ($\delta V_E$ and $\delta V_N$) are obtained from the product of the azimuth misalignment angle and the velocity change (the acceleration) of the INS. The measurements used to quantify and estimate the azimuth misalignment angle $\phi_D$ are the horizontal velocities. Therefore, increasing the linear acceleration in a controlled fashion within a given volume in the drilling pipe can improve the measurement process. This can be achieved with an appropriate linear IDA maneuver, as described earlier in this patent document. The type of IDA that will be explored is of a controlled linear motion collinear with the main axis of the pipe, along which the INS capsule will be accelerated. Due to its linear acceleration along the axis, this type of maneuver will be termed axial IDA.

There are several error models used to describe the behavior of INS error propagation. The strapdown INS error model is important for analyzing error performance of navigation systems and for designing a proper "optimal" filter. There are two main approaches to the derivation of INS error models. The first is known as the perturbation (or true-frame) approach, and the other is called the "Psi-angle" (or computer-frame) approach. In the perturbation error model, the nominal nonlinear navigation equations are perturbed in the local level North-pointing Cartesian coordinate system that corresponds to the true geographic location of the INS. The "Psi-angle" error model is obtained when the nominal equations are perturbed in the local-level North-pointing coordinate system that corresponds to the geographic location indicated by the INS. It was shown that both models yield identical results. For the purpose of the following analysis, the commonly used "Psi error model" is used. The "Psi ($\Psi$) error model" is an error model with respect to Earth as seen by an observer positioned in the computer coordinate system, in the Earth coordinate system or in any known coordinate system.

The general relation that represents the $\Psi$ error model is:

$$\dot{x}=Ax+\omega \tag{22}$$

where A is the dynamics matrix of the system, w is the process noise and x is the state vector that consists of the following components:

$$x^T[V_N V_E V_D \phi_N \phi_E \phi_D d^{*T}] \tag{23}$$

where $V_N$ is the North (N) component of the velocity error, $V_E$ is its East (E) component, $V_D$ is its Down (D) component, $\phi_N$ is the N component of the misalignment, $\phi_E$ is its E component, and $\phi_D$ is its D component. The vector d* describes the error state of the three accelerometers and the three gyros. At this stage, we will assume that these sensors are subject to bias errors only. The vector d* is described by the following relation:

$$d^{*T}=[B_N B_E B_D D_N D_E D_D] \tag{24}$$

where $B_N$ is the N accelerometer bias, $B_E$ is the E accelerometer bias, $B_D$ is the D accelerometer bias, $D_N$ is the N gyro constant drift, $D_E$ is the E gyro constant drift, and $D_D$ is the D gyro constant drift. The process noise vector is described by the following:

$$w^T=[0\ 0\ 0\ 0\ 0\ 0\ w_{\nabla N} w_{\nabla E} w_{\nabla D} w_{\epsilon N} w_{\epsilon E} w_{\epsilon D}] \tag{25}$$

where $w_{\epsilon N/E/D}$ are the noise processes related to the N, E and D gyros, respectively, and $w_{\nabla N/E}$ are the noise processes related to the N, E and D accelerometers respectively.

The overall 12 states that are included in the state vector x are:

$V_N$ North component of the velocity error
$V^E$ East component of the velocity error
$V_D$ Down component of the velocity error
$\phi_N$ North component of the misalignment
$\phi_E$ East component of the misalignment $$\phi_D \text{ Down component of the misalignment} \tag{26}$$

$B_N$ North accelerometer bias
$B_E$ East accelerometer bias
$B_D$ Down accelerometer bias
$D_N$ North gyro constant drift
$D_E$ East gyro constant drift $D_D$ Down gyro constant drift The state vector x is:

$$x^T[V_N V_E V_D \phi_N \phi_E \phi_D B_N B_E B_D D_N D_E D_D] \tag{27}$$

The duration of the alignment phase is short, and it is reasonable to assume that for these short periods the dynamic equation for the sensors error state vector d is constant:

$$\dot{d}=0. \tag{28}$$

Similarly, it can be assumed that d vector components are stochastic processes that behave as a first order Gaussian Markov (GM) process with a very long time constant compared to the time duration of the proposed IDA process.

The general dynamic matrix describing the dynamics of the system is:

$$A=\begin{bmatrix} \overline{\Omega} & F & I & \overline{0} \\ \overline{0} & \Omega & \overline{0} & I \\ \overline{0} & \overline{0} & \overline{0} & \overline{0} \\ \overline{0} & \overline{0} & \overline{0} & \overline{0} \end{bmatrix} \tag{29}$$

where $\overline{\Omega}$ is the transition matrix of velocity errors:

$$\overline{\Omega}=\begin{bmatrix} 0 & \overline{\Omega}_D & -\overline{\Omega}_E \\ -\overline{\Omega}_D & 0 & \overline{\Omega}_N \\ \overline{\Omega}_E & -\overline{\Omega}_N & 0 \end{bmatrix} \tag{30}$$

The $\overline{\Omega}$ matrix components are:

$$\overline{\Omega}_N=(2\omega+\check{\lambda})\cos(L)$$

$$\overline{\Omega}_E=-\check{L}$$

$$\overline{\Omega}_D=-(2\omega+\check{\lambda})\sin(L). \tag{31}$$

where ω is the Earth rotation rate (15.04 deg/hour), and λ and L are the longitude and the latitude of the INS location, respectively. The derivatives of the longitude and the latitude, $\dot{\lambda}$ and $\dot{L}$, are velocity components related to the transport rate vector, which defines the turn rate of the local geographic frame with respect to the fixed frame of the Earth.

The transition matrix of gyro errors Ω is defined as:

$$\Omega=\begin{bmatrix} 0 & \Omega_D & -\Omega_E \\ -\Omega_D & 0 & \Omega_N \\ \Omega_E & -\Omega_N & 0 \end{bmatrix} \tag{32}$$

and its components are:

$$\Omega_N=(\omega+\check{\lambda})\cos(L)$$

$$\Omega_E=-\hat{L}$$

$$\Omega_D=-(\omega+\hat{\lambda})\sin(L). \tag{33}$$

The force matrix, F, is defined as:

$$F = \begin{bmatrix} 0 & -a_D & a_E \\ a_D & 0 & -a_N \\ -a_E & a_N & 0 \end{bmatrix} \tag{34}$$

where the specific forces (related to the reference frame) are sensed by the INS accelerometers and are defined as:

$a_N$—North component of the specific force;

$a_E$—East component of the specific force;

$a_D$—Down component of the specific force;

It is important to note that during the alignment process, the only component in A which is influenced externally is the specific force matrix (assuming that the dependence of A components on λ and L is negligible). During the alignment process, the change in position is small, permitting the assumption that the latitude and the longitude are the same along the process. In Eq. 29, $\overline{0}$ is an all-zero 3×3 matrix.

The measurement matrix, H, is based on the observables of the velocity, the $V_N$, $V_E$, $V_D$ error states. These observables depend on the differences between the velocity components provided by the IDA reference system and those computed by the INS:

$$H = \begin{bmatrix} 1 & 0 & 0 & \vdots & 0 & 0 & 0 & 0 & 0 & 0 & 0 & 0 \\ 0 & 1 & 0 & \vdots & 0 & 0 & 0 & 0 & 0 & 0 & 0 & 0 \\ 0 & 0 & 1 & \vdots & 0 & 0 & 0 & 0 & 0 & 0 & 0 & 0 \end{bmatrix} \tag{35}$$

$$\text{or } H = [I \vdots 0_{3\times 9}]$$

or $H=[I:U_{9\times 9}]$ where I stands for the identity matrix of order 3 and $\mathbf{0}_{3\times 9}$ is a 3×9 zero matrix.

In the case of horizontal motion only, the vertical axes motion is damped. In this scenario, there is no motion in D-direction, which allows reducing the state order of the system eliminating the states related to the vertical axis velocity $V_D$. This includes the state $V_D$ itself and the accelerometer associated with it. The modified reduced 10-state model is $$x_{10}^T=[V_N,V_E,\phi_N,\phi_E,\phi_D,B_N,B_E,D_N,D_E,D_D] \tag{36}$$

and the appropriate system model is:

$$A_{10} = \begin{bmatrix} \overline{\Omega}'_{2\times 2} & F_{2\times 3} & I_{2\times 2} & \overline{0}_{2\times 3} \\ \overline{0} & \Omega & \overline{0} & I_{3\times\times} \\ \overline{0} & \overline{0} & \overline{0} & \overline{0} \\ \overline{0} & \overline{0} & \overline{0} & \overline{0} \end{bmatrix} \tag{37}$$

where:

$$\overline{\Omega}' = \begin{bmatrix} 0 & \overline{\Omega}_D \\ -\overline{\Omega}_D & 0 \end{bmatrix} \tag{38}$$

$$F_{2\times 3} = \begin{bmatrix} 0 & -F_D & F_E \\ F_D & 0 & -F_N \end{bmatrix}$$

and $I_{N\times N}$ stands for the identity matrix of order N. Since the vertical velocity $V_D$ is omitted, the corresponding measurement matrix, $H_{10}$ is:

$$H_{10} = \begin{bmatrix} 1 & 0 & 0 & 0 & 0 & 0 & 0 & 0 & 0 & 0 \\ 0 & 1 & 0 & 0 & 0 & 0 & 0 & 0 & 0 & 0 \end{bmatrix} \tag{39}$$

$$\text{or } [I_{2\times 2} \vdots 0_{2\times 5}]$$

Based on the previous definition of the system dynamic matrix A and the measurement matrix H, the appropriate observability matrix can be obtained as:

$$Q^T = \begin{bmatrix} I & \overline{\Omega} & \overline{\Omega}^2 & \overline{\Omega}^3 \\ 0 & F & \overline{\Omega}\cdot F + F\cdot\Omega & \overline{\Omega}^2\cdot F + (\overline{\Omega}\cdot F + F\cdot\Omega)\cdot\Omega \\ 0 & I & \overline{\Omega} & \overline{\Omega}^2 \\ 0 & 0 & F & \overline{\Omega}\cdot F + F\cdot\Omega \end{bmatrix} \tag{40}$$

$$Q = \begin{bmatrix} I & 0 & 0 & 0 \\ \overline{\Omega} & F & I & 0 \\ \overline{\Omega}^2 & \overline{\Omega}\cdot F + F\cdot\Omega & \overline{\Omega} & F \\ \overline{\Omega}^3 & \overline{\Omega}^2\cdot F + (\overline{\Omega}\cdot F + F\cdot\Omega)\cdot\Omega & \overline{\Omega}^2 & \overline{\Omega}\cdot F + F\cdot\Omega \end{bmatrix}$$

A sequence of the following row manipulation (maintaining the same matrix rank)

1.→row2−$\overline{\Omega}$·row1

2.→row3−$\overline{\Omega}^2$·row1

3.→row4−$\overline{\Omega}^3$·row1

4.→row3−$\overline{\Omega}$row2

5.→row4−$\overline{\Omega}^2$ row2

6.→row4−row3·Ω

7.→row4−$\overline{\Omega}$·row3

8.→row3:F provides the following closed form of the observability matrix $\hat{Q}$:

$$\hat{Q} = \begin{bmatrix} I & 0 & 0 & 0 \\ 0 & F & I & 0 \\ 0 & \Omega & 0 & I \\ 0 & 0 & 0 & 0 \end{bmatrix} \tag{41}$$

All components represent 3×3 matrices and I stand for identity matrix of size 3. It is obvious that the closed form of the observability matrix $\hat{Q}$ has a rank of 9 (out of 12), indicating three unobservable states.

In this section, IDA scenarios with added accelerated induced motion to the North are analyzed. The assumption of North direction is used to simplify matrix manipulation and ranking testing. Then, the North-directed motion is augmented with perpendicular induced motion in the horizontal plane. Such a trajectory may be limited in real life cases. Direction can be easily generalized for any horizontal induced motion. In the following, two cases of state matrix size are discussed: (1) a case of a full three-dimensional INS dynamic system with 12 states; and (2) a case of 10 states where the vertical channel was assumed to be damped and the related states (vertical velocity and vertical accelerometer bias) were omitted. The measurement matrices are adjusted accordingly.

The model described in Eq. 29 was fully utilized. The basic phase of the INS being stationary (can be in motion but with no induced acceleration) was augmented by a trajectory path with induced motion to the North. The accumulated observability for this case is shown in Eq. 42. Note the addition of another stage with induced acceleration, F', detailed in Eq. 43.

$$\hat{Q}' = \begin{bmatrix} I & 0 & 0 & 0 \\ 0 & F & I & 0 \\ 0 & \Omega & 0 & I \\ 0 & 0 & 0 & 0 \\ I & 0 & 0 & 0 \\ 0 & F' & I & 0 \\ 0 & \Omega & 0 & I \\ 0 & 0 & 0 & 0 \end{bmatrix} \Rightarrow \begin{bmatrix} I & 0 & 0 & 0 \\ 0 & F & I & 0 \\ 0 & \Omega & 0 & I \\ I & 0 & 0 & 0 \\ 0 & F' & I & 0 \\ 0 & \Omega & 0 & I \end{bmatrix} \Rightarrow \begin{bmatrix} I & 0 & 0 & 0 \\ 0 & F & I & 0 \\ 0 & \Omega & 0 & I \\ 0 & \frac{F'-F}{F_N} & 0 & 0 \end{bmatrix} \tag{42}$$

$$\begin{aligned} F_N &\equiv F' - F \\ &= \begin{bmatrix} 0 & -a_D & 0 \\ a_D & 0 & -a_N \\ 0 & a_N & 0 \end{bmatrix} - \begin{bmatrix} 0 & -a_D & 0 \\ a_D & 0 & 0 \\ 0 & 0 & 0 \end{bmatrix} \\ &= \begin{bmatrix} 0 & 0 & 0 \\ 0 & 0 & -a_N \\ 0 & a_N & 0 \end{bmatrix} \end{aligned} \tag{43}$$

The rank of $F_N$ was 2. Therefore, the additional induced motion increased the rank of $\hat{Q}'$ to 11. A similar manipulation with $a_E$ (induced acceleration perpendicular to the previous one) introduced another independent row to the accumulated observability matrix:

$$\begin{aligned} F_E &\equiv F' - F \\ &= \begin{bmatrix} 0 & -a_D & a_E \\ a_D & 0 & 0 \\ -a_E & 0 & 0 \end{bmatrix} - \begin{bmatrix} 0 & -a_D & 0 \\ a_D & 0 & 0 \\ 0 & 0 & 0 \end{bmatrix} \\ &= \begin{bmatrix} 0 & 0 & a_E \\ 0 & 0 & 0 \\ -a_E & 0 & 0 \end{bmatrix} \end{aligned} \tag{44}$$

and the overall observability matrix became:

$$\hat{Q}'' = \begin{bmatrix} I & 0 & 0 & 0 \\ 0 & F & I & 0 \\ 0 & \Omega & 0 & I \\ 0 & F_N & 0 & 0 \\ 0 & F_E & 0 & 0 \end{bmatrix} \tag{45}$$

This expression was minimized and the two additional lower rows provided an additional rank of 3 to the original observability matrix $\hat{Q}$, resulting in an overall rank of 12, giving full observability to the state system matrix of order 12.

Following the general definition of $\hat{Q}$ we obtained previously, it could be easily demonstrated that the appropriate observability matrix for the damped vertical channel became:

$$\hat{Q}_{10} = \begin{bmatrix} I_{2\times2} & 0_{2\times3} & 0_{2\times2} & 0_{2\times3} \\ 0_{2\times2} & F'_{2\times3} & I_{2\times2} & 0_{2\times3} \\ 0_{3\times2} & \Omega_{3\times3} & 0_{3\times2} & I_{3\times3} \\ 0_{3\times2} & 0_{3\times3} & 0_{3\times3} & 0_{3\times3} \end{bmatrix} \tag{46}$$

where the matrix sizes are defined in the lower right corner of the symbols. The formation of $F_{2\times3}$ was based on the previous definition of the force matrix F, and since the vertical channel was damped, it was described as follows:

$$F'_{2\times3} = \begin{bmatrix} 0 & -F_D & F_E \\ F_D & 0 & -F_N \end{bmatrix} \tag{47}$$

Clearly the rank of $Q_{10}$ became 7. Similarly to the process in Case 1, the stationary phase was augmented with an induced North acceleration phase. The combined observability matrix became:

$$\hat{Q}'_{10} = \begin{bmatrix} I_{2\times2} & 0_{2\times3} & 0_{2\times2} & 0_{2\times3} \\ 0_{2\times2} & F_{2\times3} & I_{2\times2} & 0_{2\times3} \\ 0_{3\times2} & \Omega_{3\times3} & 0_{3\times2} & I_{3\times3} \\ 0_{3\times2} & 0_{3\times3} & 0_{3\times3} & 0_{3\times3} \\ I_{2\times2} & 0_{2\times3} & 0_{2\times2} & 0_{2\times3} \\ 0_{2\times2} & F'_{2\times3} & I_{2\times2} & 0_{2\times3} \\ 0_{3\times2} & \Omega_{3\times3} & 0_{3\times2} & I_{3\times3} \\ 0_{3\times2} & 0_{3\times3} & 0_{3\times3} & 0_{3\times3} \end{bmatrix} \Rightarrow \tag{48}$$

$$\begin{bmatrix} I_{2\times2} & 0_{2\times3} & 0_{2\times2} & 0_{2\times3} \\ 0_{2\times2} & F_{2\times3} & I_{2\times2} & 0_{2\times3} \\ 0_{3\times2} & \Omega_{3\times3} & 0_{3\times2} & I_{3\times3} \\ I_{2\times2} & 0_{2\times3} & 0_{2\times2} & 0_{2\times3} \\ 0_{2\times2} & F'_{2\times3} & I_{2\times2} & 0_{2\times3} \\ 0_{2\times2} & \Omega_{3\times3} & 0_{3\times2} & I_{3\times3} \end{bmatrix} \Rightarrow$$

$$\begin{bmatrix} I_{2\times2} & 0_{2\times3} & 0_{2\times2} & 0_{2\times3} \\ 0_{2\times2} & F_{2\times3} & I_{2\times2} & 0_{2\times3} \\ 0_{3\times2} & \Omega_{3\times3} & 0_{2\times2} & I_{3\times3} \\ 0_{2\times2} & \frac{F'-F}{F_{N2\times2}} & 0_{2\times2} & 0_{2\times2} \end{bmatrix}$$

where $$\begin{aligned} F_{N2\times3} &\equiv F' - F \\ &= \begin{bmatrix} 0 & -a_D & 0 \\ a_D & 0 & -a_N \end{bmatrix} - \begin{bmatrix} 0 & -a_D & 0 \\ a_D & 0 & 0 \end{bmatrix} \\ &= \begin{bmatrix} 0 & 0 & 0 \\ 0 & 0 & -a_N \end{bmatrix} \end{aligned} \tag{49}$$

The rank of $F_{N2\times3}$ was 1. Thus, the additional induced motion increased the rank of $\hat{Q}'$ to 8. A similar manipulation with $a_E$ introduced another row to the accumulated observability matrix:

$$F_{E2\times3} \equiv F' - F \tag{50}$$

-continued $$= \begin{bmatrix} 0 & -a_D & a_E \\ a_D & 0 & 0 \end{bmatrix} - \begin{bmatrix} 0 & -a_D & 0 \\ a_D & 0 & 0 \end{bmatrix}$$

$$= \begin{bmatrix} 0 & 0 & a_E \\ 0 & 0 & 0 \end{bmatrix}$$

In contrast to the previous case, the new row was linearly dependent of the one due to the induced North acceleration. Therefore, the rank did not increase with that added perpendicular motion and there were still 2 states which remained unobservable. The overall observability matrix became:

$$\hat{Q}_{10}'' = \begin{bmatrix} I_{2\times2} & 0_{2\times2} & 0_{2\times2} & 0_{2\times3} \\ 0_{2\times2} & F_{2\times3} & I_{2\times2} & 0_{2\times3} \\ 0_{3\times2} & \Omega_{3\times3} & 0_{3\times2} & I_{3\times3} \\ 0_{2\times2} & F_{N2\times3} & 0_{3\times3} & 0_{3\times3} \end{bmatrix} \tag{51}$$

$F_{E2\times3}$ was used instead of $F_{N2\times3}$ and there was no difference in the order with respect to the observability ranking, even though the induced acceleration in the horizontal plane was taken into account.

In the case of a 12 state system matrix, from Eq. 41 the rank of the observability matrix was derived as 9, and the observable states were the 3 measured states and the vertical accelerometer drift ($V_N$, $V_E$, $V_D$ and $D_D$). The overall observable states were:

$$V_N, V_E, V_D, B_D$$

$$-g\phi_E + B_N$$

$$-g\phi_N + B_E$$

$$\Omega_D\phi_E - \Omega_E\phi_D + D_N$$

$$\Omega_N\phi_D - \Omega_D\phi_N + D_E$$

$$\Omega_E\phi_N - \Omega_N\phi_E + D_D \tag{52}$$

With the added IDA process of inducing accelerated motion in the North direction, the rank of the observability in Eq. 41 grew to 11. The overall observable states were:

$$V_N, V_E, V_D, \phi_D, \phi_E, B_D, B_N, B_N, D_N$$

$$-g\phi_N + B_E$$

$$-\Omega_D\phi_N + D_E$$

$$\Omega_E\phi_N + D_D \tag{53}$$

where the azimuth became clearly observable. If there was a possibility of initiating a perpendicular acceleration, then the observability matrix would be a full rank.

In the case of a 10-state system matrix, the 10-state vector is:

$$x_{10}^T = [V_N V_E \phi_N \phi_E \phi_D B_N B_E D_N D_E D_D] \tag{54}$$

Following from Eq. 46, we extracted the following observable state relations for the stationary observability:

$$V_N, V_E$$

$$-g\phi_E + B_N$$

$$-g\phi_N + B_E$$

$$\Omega_D\phi_E - \Omega_E\phi_E + D_N$$

$$-\Omega_D\phi_N - \Omega_N\phi_D + D_E$$

$$\Omega_E\phi_E - \Omega_N\phi_E + D_D \tag{55}$$

which meant that the states related to the horizontal velocities were observable (since they were measured). The rank of the unobservable space was 3. There is a variety of possibilities to select the three free states that can create the standard vectors. With the added IDA process, the state relations within the new observability matrix derived in Eq. (51) become:

$$V_N, V_E, \phi_D$$

$$-g\phi_E + B_N$$

$$-g\phi_N + B_E$$

$$\Omega_D\phi_E - \Omega_E\phi_E + D_N$$

$$-\Omega_D\phi_N - \Omega_N\phi_D + D_E$$

$$\Omega_E\phi_E - \Omega_N\phi_E + D_D \tag{56}$$

which shows that the azimuth angle also turned observable.

The preceding observability analysis assumed induced accelerated motion in directions that coincided with either North (or East) direction. In practical cases the direction of the motion in the horizontal plane is random. This means that the induced motion has components in the North and the East directions at the same time. Consequently, in the 12-states case the observability matrix from Eq. (33) benefits from having a modified $F_N$:

$$F_N \equiv F' - F \tag{57}$$

$$= \begin{bmatrix} 0 & -a_D & a_E' \\ a_D & 0 & -a_N' \\ -a_E' & a_N' & 0 \end{bmatrix} - \begin{bmatrix} 0 & -a_D & 0 \\ a_D & 0 & 0 \\ 0 & 0 & 0 \end{bmatrix}$$

$$= \begin{bmatrix} 0 & 0 & a_E' \\ 0 & 0 & -a_N' \\ -a_E' & a_N' & 0 \end{bmatrix}$$

where the induced acceleration magnitude is $a=\sqrt{a'^2_E + a'^2_N}$ ($a'_E$ and $a'^2_N$ are the induced acceleration projections in East and North directions). This means that in the case where there are projections on both axes (North and East), there is an increase to full observability. In the 10-states case there is no change and the observability exhibits the same increase to 8.

The above discussion evaluated the utilization of analytical observability definitions to assess the IDA process contribution, with a particular attention to the azimuth angle observability for improving the alignment process. It was found that the induced motion in the IDA phase increased the observability rank which encompassed the azimuth. Induced horizontal acceleration changed the azimuth angle to an observable state, thus improving its estimation. A 12-state model improved system observability in the IDA process. The addition of another available measurement benefited system observability. In the case where North and East induced accelerations could be invoked, full system observability was gained. This result can be extended to induced acceleration in two perpendicular horizontal directions.

In practical cases of horizontal drilling, where it is expected to have an acceleration component on the North-South and the East-West axes at the same time, full observability can be gained in one phase.

In the case of a 10-state model, the utilization of the damped vertical axis assumption reduced the computational load on the filtering system. However, due to the fact that the number of measurements was reduced, the system observability was reduced and was limited to 8 states out of 10. The fact that the states were considered to be observable provided only partial information regarding the efficiency and the quality of the estimation of these states. For example, induced motion of 1 milli-g and 1 g would both satisfy the requirements for increased observability. However, it is shown later in this document that the level of the induced motion very significantly influences the ability of the estimation process to perform well.

Based on the INS error model which defines our system model, optimal linear filtering utilizing Kalman filter implementation is utilized. In general, in a linear system state model induced by white (uncorrelated) Gaussian noise, a direct utilization of the Kalman filter is appropriate and proven to be the optimal estimator.

Figure 12:
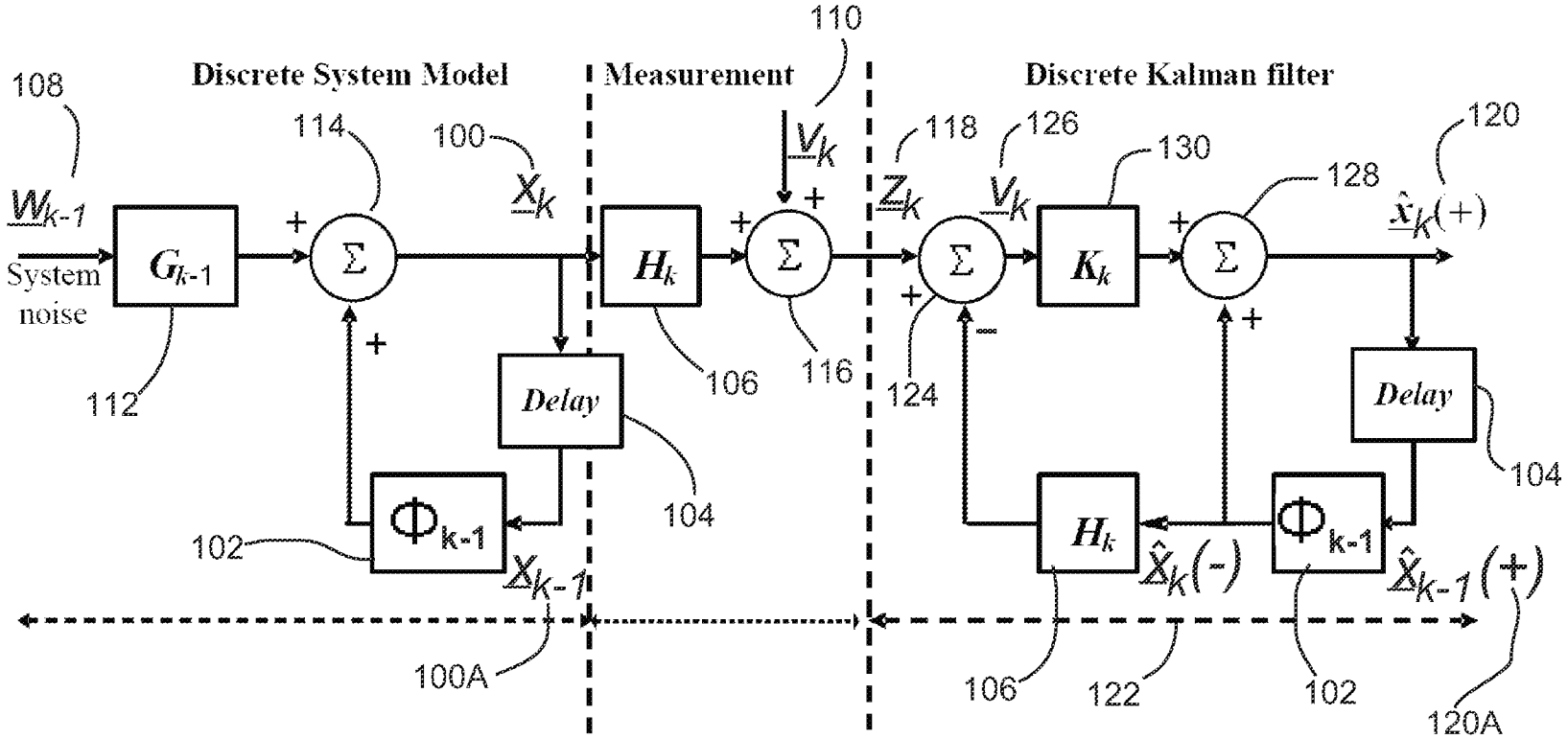
FIG. 12 is a schematic diagram showing the operation of a system and a Kalman filter estimating it based on measurements.

The general structure of this system data processing is based on a measurement output from the system model, which is then used by the Kalman filter to optimize the data processing for optimally minimizing (in the least mean variance sense) the estimation of the state vector. This process is shown in FIG. 12. The general description of such a system model is:

$$x_k=\Phi_{k-1}x_{k-1}+G_{k-1}w_{k-1} \tag{58}$$

shown in FIG. 12 as the state-vector-modifying summation 114, and the measurement model is:

$$z_k=H_kx_k+v_k \tag{59}$$

shown in FIG. 12 as measurement-producing summation 116, where $x_k$ is the state vector 100 (in our case, the INS state vector) at discrete sample k (corresponding to time $t_k$), and $x_{k-1}$ is the state vector 100A at time $t_{k-1}$, $\Phi_{k-1}$ defines the transition matrix 102 from time $t_{k-1}$ to time $t_k$ separated by delay 104, $H_k$ is the measurement matrix 106, and $w_{k-1}$ and $v_k$ stand respectively for the process noise 108 (or, the random forcing function) and measurement noise 110. Both, the process and measurement noises are assumed to be white Gaussian random processes (sequences, for the discrete case) and also, both sequences are assumed not to be correlated (i.e. $E(w_kv_k^T)=0$). $w_{k-1}$ is usually defined to have a unity variance, and $G_{k-1}$ is its coefficient vector 112. Measurement-producing summation 116 produces $z_k$, the measurement 118.

A Kalman filter is utilized to estimate the error states using its sequential recursive algorithm. A part of its algorithm is the availability of the estimation accuracy covariance that is extremely beneficial for on-line and off-line performance evaluation. The Kalman filter algorithm is divided into prediction and update phases. During the update phase the filter is extrapolating the estimated state and the error covariance matrices. These extrapolated values are then utilized during the update phase. In the latter, the state estimate and the error covariance of the estimation process are modified according to the extrapolated values and the measurement input. The formulation which implements this algorithm is:

Extrapolation:

$$\hat{x}_k(-)=\Phi_{k-1}\hat{x}_{k-1}(+)$$

$$P_k(-)=\Phi_{k-1}\hat{P}_{k-1}(+)\Phi_{k-1}^T+Q_{k-1} \tag{60}$$

Update:

$$K_k=P_k(-)H_k^T[H_kP_k(-)H_k^T+R_k]^{-1}$$

$$\hat{x}_k(+)=\hat{x}_k(-)+K_k[z_k-H_k\hat{x}_k(-)]$$

$$P_k(+)=[I-K_kH_k]P_k(-) \tag{61}$$

In the previous equations, $K_k$ and $P_k$ are the Kalman gain 130 and the covariance at time $t_k$. A negative (−) sign defines a value based on prediction (in the extrapolation phase of the filter) and the positive (+) sign refers to a value obtained after an update based on measurement. The "hat" (ˆ) sign stands for an estimated value. $P_k$, is the error covariance matrix of the state vector $x_k$, which is generated by the filter as part of its algorithm, and is defined as $$P_k\equiv E[(x_k-\hat{x}_k)(x_k-\hat{x}_k)^T] \tag{62}$$

The Kalman filter operation is as follows: transition matrix 102 is applied to the previous estimated system state 120A to obtain predicted system state 122. Discrepancy-obtaining summation 124 takes the measurement 118 and subtracts a predicted measurement, obtained by applying measurement matrix 106 to predicted system state 122. The result of discrepancy-obtaining summation 124 is discrepancy 126. New estimated system state 120 is obtained by system estimation summation 128 by adding to predicted system state 122 the result of applying the Kalman gain 130 to discrepancy 126.

At the start of the operation of the Kalman filter, an estimate of the initial state and an estimate of the error covariance of the estimate of the initial state can be obtained by other methods. The error covariance is not shown in FIG. 12, but the Kalman gain 130 depends on the covariance.

There are three main orientation parameters that are utilized in the navigation process: Pitch, Roll and Azimuth. The Pitch and Roll can be determined quite easily using zero velocity update. This is due to the fact that gravity (vertical plane) is a strong force. It has also been shown through an Observability analysis that the Azimuth angle is coupled to forces in the horizontal plane. The IDA technique is to induce these forces in the horizontal plane that will allow the Azimuth error to be determined.

Figure 20:
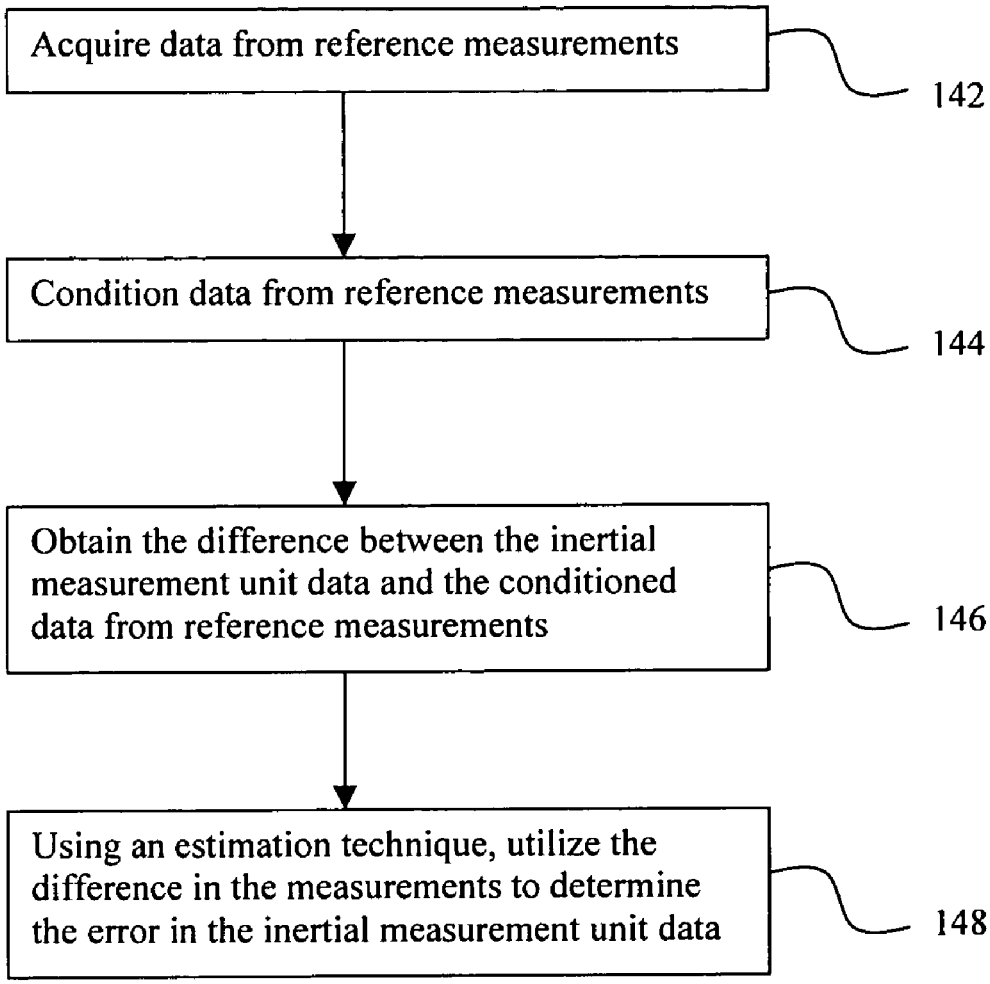
FIG. 20 is a flow chart showing the algorithmic steps involved in determining errors in an inertial measurement unit using a reference motion.

The general algorithmic steps during the IDA process are as follows, referring to FIG. 20:

1. In step 142 data from the reference measurements (controlled motion) is acquired.
2. In step 144 the reference measurements are conditioned.
3. In step 146 the difference between the inertial measurement unit data and the reference measurements are obtained.
4. In step 148, using an estimation technique (eg Kalman Filtering), the difference in the measurements is utilized to determine the error in the Azimuth.

The Kalman Filter is an iterative process. It has been shown that the stronger the forces in the horizontal plane, the less iterations are required to determine the error. This is important in directional drilling as there is a limited amount of time when the drill bit is idle.

The Kalman Filter utilizes a system model to determine the errors. By having a reference motion combining linear and rotational motion, the Kalman Filter will have more direct information to determine the measurement errors. The accelerometers (linear motion) and gyroscopes (rotational motion) measure different types of motion and a combined movement would allow the errors in each to be determined. The two types of motions can be separated in signal processing for corrections and the one combined motion is efficient for the drilling process as drill bit idle time is limited. Gyroscope measurements (rotational) have a lot more random noise than accelerometers (linear) and a reference motion should greatly aid in the error reduction.

While a Kalman filter without back correction provides the best current estimate of the system state given the previous data, future data may allow improved estimates of past states. While this may not be particularly important during an IDA process, in the time between IDA processes it may be. Since the position is determined via an integration of past velocities, a back correction may be applied to previous estimates of the system state to provide a better estimate of current position.

To simulate the effect of an IDA process with linear acceleration on azimuth errors for a high grade INS, the following initial covariance errors were utilized:

$\sigma_{V_E}=\sigma_{V_N}=0.2$ m/s; $\sigma_{B_E}=\sigma_{B_N}=100$ μg $\sigma_{D_E}=\sigma_{D_N}=0.01$ deg/h $\sigma_{\Phi_N}=\sigma_{\Phi_E}=1$ deg; $\sigma_{\Phi_D}=3$ deg; $\sigma_{D_D}=0.025$ deg/h Where g stands for the gravity acceleration (~9.8 $ms^{-2}$).

Figure 13:
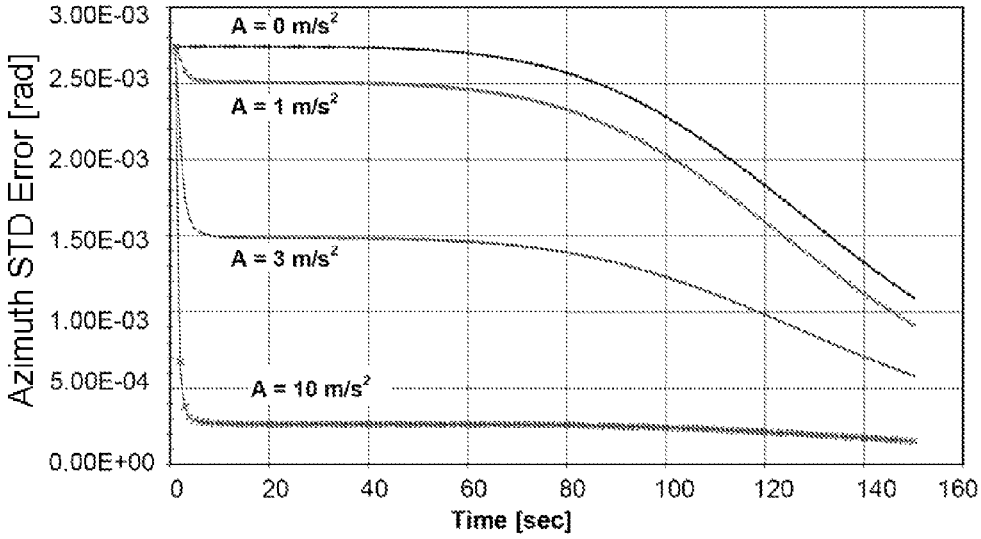
FIG. 13 is a graph showing a simulation of azimuth misalignment over time for several accelerations with a high grade inertial navigation system.

In addition, the noises were presumed to be a $1^{st}$ order Gauss-Markov (GM) processes with time constants in the order of ~$10^7$ s, which justifies the previous assumption of constant biases. FIG. 13 illustrates the improvement in the convergence process of the estimated azimuth angle error. Increasing the evoked acceleration dramatically reduced the convergence duration. The steady state level after the convergence phase reflects the theoretical limit due to the accelerometer bias drift level.

To simulate the error reduction for a tactical grade IMU the following parameters were used:

$\sigma_{V_E}=\sigma_{V_N}=0.2$ m/s; $\sigma_{B_E}=\sigma_{B_N}=2$ mg $\sigma_{D_E}=\sigma_{D_N}=10$ deg/h $\sigma_{\Phi_N}=\Phi_{\Phi_E}=1$ deg;

$\sigma_{\Phi_D}=6.5$ deg; $\sigma_{D_D}=10$ deg/h

Figure 14:
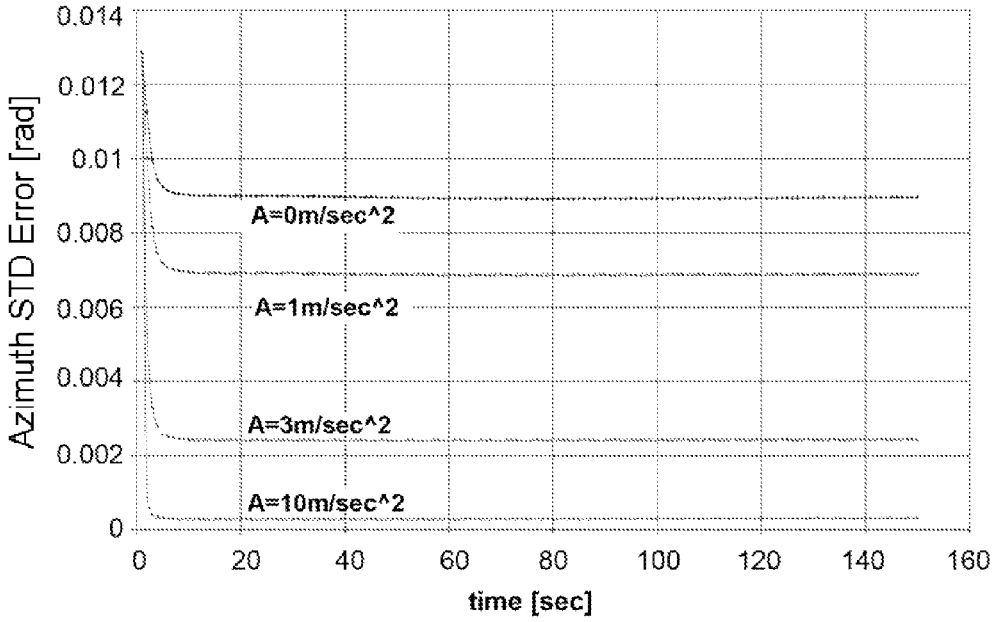
FIG. 14 is a graph showing a simulation of azimuth misalignment over time for several accelerations with a tactical grade inertial navigation system.

A similar $1^{st}$ order Gauss-Markov model was used for the noise process. Results from this simulation are depicted on FIG. 14.

The results clearly demonstrate the significant improvement in convergence time and in the error reduction achieved for a given IDA duration, due to the increase in the acceleration. This illustrates the improved observability of the azimuth angle associated with the IDA.

In this set of tests, it was useful to examine some specific cases where values and relations between the biases and the constant drifts made it possible to introduce some analytical approximations. These approximations were then compared with simulation results. This approach follows a methodology that has been previously suggested for evaluating and comparing alignment method for different quality types of INS.

The first scenario assumes that the initial gyro drift rates are small. In this case, the error propagation of the horizontal velocity components $V_E$ and $V_N$ is governed by the azimuth misalignment, $\phi_D$, which is to be estimated. For the duration of the IDA process, the value of $\phi_D$ is assumed constant, which is quite reasonable, based on the low level of the D-gyro constant drift $D_D$. With these assumptions, the INS error propagation model described in Eq. 22 can be modified to the following third-order model:

$$\dot{x}_3=A_3(t)x_3 \tag{63}$$

where $$x_3^T=[V_N V_E \Phi_D] \tag{64}$$

and $A_3$ is given by $$A_3=\begin{bmatrix} 0 & 0 & \Gamma_E(t) \\ 0 & 0 & -\Gamma_N(t) \\ 0 & 0 & 0 \end{bmatrix} \tag{65}$$

where $\Gamma_N(t)$ and $\Gamma_E(t)$ stand for the acceleration towards the North and the East, respectively.

The suitable measurement is reduced to:

$$H_3=\begin{bmatrix} 1 & 0 & 0 \\ 0 & 1 & 0 \end{bmatrix} \tag{66}$$

Moreover, the measurement error matrix R is assumed to be diagonal (since there is no error cross-correlation between the two velocity measurements), with identical noise variance values for both velocity measurement processes.

$$R=\begin{bmatrix} \sigma_v^2 & 0 \\ 0 & \sigma_v^2 \end{bmatrix} \tag{67}$$

where $\sigma_v^2$ is the velocity measurement error variance.

In the worse case, there is no a priori information on $x_3$ which means that the inverse of the covariance matrix of the reduced state vector $x_3$, $P_3^{-1}(0)=0$. Following a methodology previously described by Gelb, and adopting the obvious assumption that the process noise $Q_3=0$ (see Eq.3.16):

$$P_3^{-1}(t)=\int_0^t \Phi_3^T(\tau,t)H_3^T(\tau)R^{-1}H_3(\tau)\Phi_3(\tau,t)d\tau \tag{68}$$

where $\phi_3(\tau, t)$ is the transition matrix that corresponds to the reduced INS error propagation model, $A_3$ (see Eq. 65) and H and R (the matrices defined in Eqs. 66 and 67) are the measurement and the measurement error matrices respectively. If the integral is positive definite for some t>0, then $P_3^{-1}(t)>0$, which means that $0<P_3(t)<\infty$. It follows that by appropriately utilizing these measurements, it is possible to decrease the estimation error variance about states that are initially completely unknown. The system is considered uniformly completely observable when the integral is positive definite and bound for some t>0.

A good quantitative measure of the observability of the azimuth ($\phi_D$) is its estimated error, which is the element (3, 3) in the covariance matrix $P_3$. This can be easily calculated for the following axial maneuver. It will be assumed (with no loss of generality) that:

$$\Gamma_N(t)=\Gamma_E(t)=0 \tag{69}$$

From Eq. 65 if follows that $$A_3=\begin{bmatrix}0&0&0\\0&0&-\Gamma\\0&0&0\end{bmatrix} \tag{70}$$

and the transition matrix is given via $\Phi_s(t,t_0)=A_3(t)\Phi_s(t,t_0)$ with the initial condition $$\Phi_3(t_0,t_0)=\begin{bmatrix}1&0&0\\0&1&0\\0&0&1\end{bmatrix} \tag{71}$$

It can be easily shown that:

$$\Phi_3(t,t_0)=\begin{bmatrix}1&0&0\\0&1&-\Gamma\cdot(t-t_0)\\0&0&1\end{bmatrix} \tag{72}$$

the integrand in Eq. 68 equals to:

$$\mathrm{int}(\tau,t)=\frac{1}{\sigma_v^2}\begin{bmatrix}1&0&0\\0&1&\Gamma\cdot(t-\tau)\\0&\Gamma\cdot(t-\tau)&\Gamma^2\cdot(t-\tau)^2\end{bmatrix} \tag{73}$$

and according to Eq. 70 the covariance matrix is:

$$P_3^{-1}(t)=\frac{1}{\sigma_v^2}\begin{bmatrix}t&0&0\\0&t&(1/2)\cdot\Gamma\cdot t^2\\0&(1/2)\cdot\Gamma\cdot t^2&(1/3)\cdot\Gamma^2\cdot t^3\end{bmatrix} \tag{74}$$

It can be noticed that for an absolute value of $\Gamma$ (acceleration) greater then zero, we are promised to have $P_3^{-1}(t)$ non-singular matrix.

Following Eq. 74, the variance of the azimuth angle can be found as:

$$P_3(3,3)=t^2/\det[P_3^{-1}(t)]\cdot\sigma_v^4 \tag{75}$$

where the determinant equals to:

$$\det[P_3^{-1}(t)]=\Gamma^2\cdot t^5/12\sigma_v^6 \tag{76}$$

which leads us to the approximated value of the azimuth variance:

$$\sigma_{\phi_D}^2=12\cdot\sigma_v^2\Gamma^2 t^3 \tag{77}$$

From Eq. 77 it can be observed that under the assumptions made, the variance approaches zero as $1/t^3$. The higher the acceleration, the faster the decrease is in the azimuth variance. The quality of the measurement is linearly related to the azimuth error variance. Within this reduced model, it can be easily seen that an east directed acceleration will have the same time dependence effect on the azimuth error variance.

Figure 15:
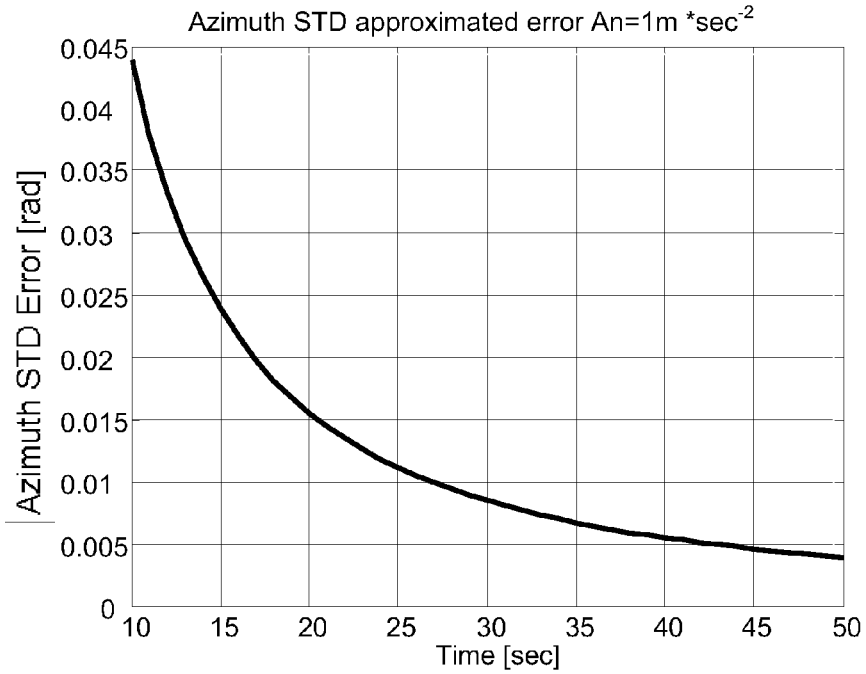
FIG. 15: is a graph showing an analytical approximation of the azimuth angle estimation error over time with a high grade inertial navigation system.

This approximation assumes that the variance should converge to zero (for a long enough duration of the IDA). Unfortunately, as seen in the simulations, this is not the actual situation. The reason is that the assumption of low gyro drifts relative to the azimuth error does not hold for low values of azimuth error. In addition, there is the fundamental limitation of the azimuth error estimation that can be achieved due to the accelerometer bias. As an example, the behaviour of the approximated analytical standard deviation azimuth angle error, for an acceleration of $\Gamma=1\ \mathrm{ms}^{-2}$ and a standard deviation velocity measurement error of $0.4\ \mathrm{ms}^{-1}$, is shown in FIG. 15.

Another analytical approximation can be achieved in a different set of assumptions. In this case, the azimuth drift rate will not be negligible, since a lower quality INS will be utilized in the modeling and estimation process. Still, the error propagation of the horizontal velocity is controlled by $\phi_D$. In this scenario, it is assumed that the initial gyro constant drift rates are large, and that the following relationships exist:

$$L\phi_D<<D_D \text{ and } ((\omega+\dot{\lambda})\cos(L))\phi_D<<D_D \tag{78}$$

However, since the azimuth gyro drift rate is large, the value of $\phi_D$ cannot be assumed to be constant during the alignment process. In this case, the propagation error model has to be reduced to a $4^{th}$ order model that includes the drift rate phenomena as well.

The system error propagation equation is approximated by:

$$\dot{x}_4=A_4(t)x_4 \tag{79}$$

where $$x_4^T=[V_N V_E \phi_D D_D] \tag{80}$$

In addition, the system transition matrix is:

$$A_4(t)=\begin{bmatrix}0&0&\Gamma_E(t)&0\\0&0&-\Gamma_N(t)&0\\0&0&0&1\\0&0&0&0\end{bmatrix} \tag{81}$$

and the measurement matrix is:

$$H_4=\begin{bmatrix}1&0&0&0\\0&1&0&0\end{bmatrix} \tag{82}$$

The measurement noise covariance matrix, R, is the same as the one given in Eq.67. In order to obtain an analytical expression of the error covariance matrix, the appropriate integral (see Eq. 68) is calculated:

$$P_4^{-1}(t) = \int_0^t \Phi_4^T(\tau, t) H_4^T(\tau) R^{-1} H_4(\tau) \Phi_4(\tau, t)\, d\tau \tag{83}$$

$\Phi_4(t,t_o)=A_4(\Phi_4(t,t_o)$ with the initial condition $$\Phi_4(t_0, t_0) = \begin{bmatrix} 1 & 0 & 0 & 0 \\ 0 & 1 & 0 & 0 \\ 0 & 0 & 1 & 0 \\ 0 & 0 & 0 & 1 \end{bmatrix}$$

As previously, it will be assumed (with no loss of generality) that:

$$\Gamma_N(t)=\Gamma\Gamma_E(t)=0$$

$$A_4(t) = \begin{bmatrix} 0 & 0 & 0 & 0 \\ 0 & 0 & -\Gamma & 0 \\ 0 & 0 & 0 & 1 \\ 0 & 0 & 0 & 0 \end{bmatrix}. \tag{84}$$

and following the relation between $A_4$ and $\Phi$ ($\Phi$=expm ($A_4$*dt), where dt is the process sampling interval), $\Phi_4$ is given with:

$$\Phi_4(t, t_0) = \begin{bmatrix} 1 & 0 & 0 & 0 \\ 0 & 1 & -\Gamma\cdot(t-t_0) & -1/2\Gamma\cdot(t-t_0)^2 \\ 0 & 0 & 1 & (t-t_0) \\ 0 & 0 & 0 & 0 \end{bmatrix} \tag{85}$$

and the integrand in Eq. 83 becomes:

$$\mathrm{int}(\tau, t) = \frac{1}{\sigma_v^2}\begin{bmatrix} 1 & 0 & 0 & 0 \\ 0 & 1 & \Gamma\cdot(t-\tau) & 1/2\cdot\Gamma\cdot(t-\tau)^2 \\ 0 & \Gamma\cdot(t-\tau) & \Gamma^2\cdot(t-\tau)^2 & 1/2\cdot\Gamma^2\cdot(t-\tau)^3 \\ 0 & 1/2\cdot\Gamma\cdot(t-\tau)^2 & 1/2\cdot\Gamma^2\cdot(t-\tau)^3 & 1/4\cdot\Gamma\cdot(t-\tau)^4 \end{bmatrix} \tag{86}$$

Consequently, the error covariance matrix is:

$$P_4^{-1}(t) = \frac{1}{\sigma_v^2}\begin{bmatrix} t & 0 & 0 & 0 \\ 0 & t & 1/2\cdot\Gamma\cdot t^2 & 1/6\cdot\Gamma\cdot t^3 \\ 0 & 1/2\cdot\Gamma\cdot t^2 & 1/3\cdot\Gamma^2\cdot t^3 & 1/8\cdot\Gamma^2\cdot t^4 \\ 0 & -1/6\cdot\Gamma\cdot t^3 & -1/8\cdot\Gamma^2\cdot t^4 & 1/20\cdot\Gamma^2\cdot t^5 \end{bmatrix} \tag{87}$$

-continued $$P_4(t) = \sigma_v^2\cdot\begin{bmatrix} 1/t & 0 & 0 & 0 \\ 0 & 9/t & 36/(t^2\cdot\Gamma) & -60/(t^3\cdot\Gamma) \\ 0 & 36/(t^2\cdot\Gamma) & 192/(t^3\cdot\Gamma^2) & -360/(t^4\cdot\Gamma^2) \\ 0 & -60/(t^3\cdot\Gamma) & -360/(t^4\cdot\Gamma^2) & 720/(t^5\cdot\Gamma^2) \end{bmatrix}. \tag{88}$$

and the error in the azimuth angle propagates in time according to the term (3,3) of Eq. 88, which is:

$$P_4(3,3)=(192\cdot\sigma_v^2)/(t^3\cdot\Gamma^2) \tag{89}$$

It can be observed that for large duration of the alignment phase t, these error values theoretically converge to zero. Naturally, this is not the actual situation due to the limitations in the validity of the assumptions.

Figure 16:
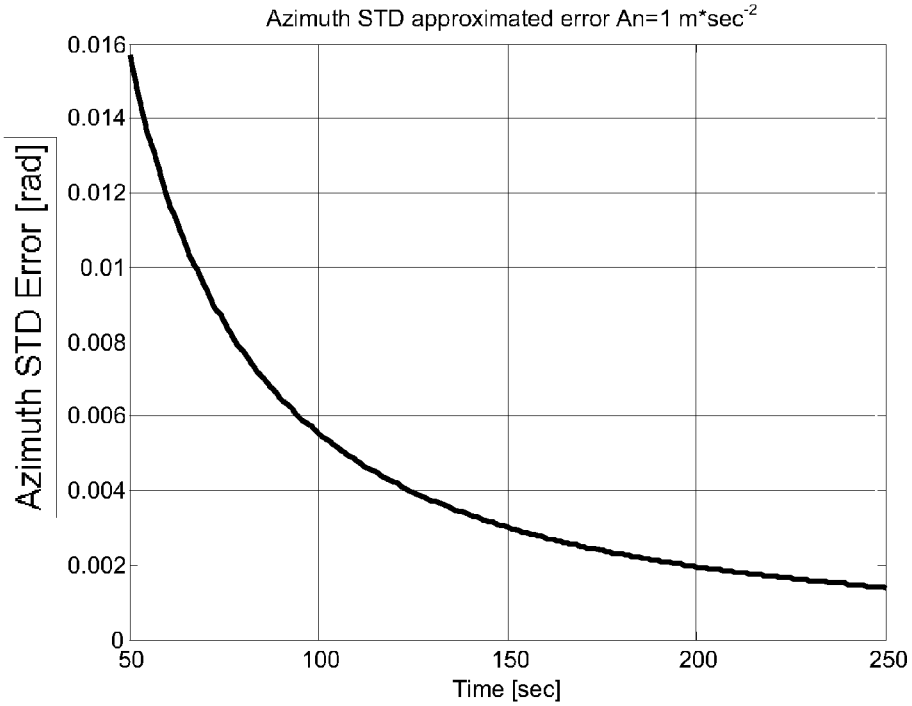
FIG. 16 is a graph showing an analytical approximation of the azimuth angle estimation error over time with a tactical grade inertial navigation system.

Similarly to the approximation of the high grade INS discussed above, it can be observed that for a long duration of the alignment phase t, this error converges theoretically to zero. This is not the actual situation due to the limitations in the validity of the assumptions. In FIG. 16 the analytical results for the standard deviation of the estimated error of the azimuth angle are given for an acceleration of 1 $ms^{-2}$ and a standard deviation velocity measurement error of 0.4 $ms^{-1}$.

Immaterial modifications may be made to the embodiments described here without departing from what is covered by the claims.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An apparatus for inertial navigation, comprising:

a piston contained within a cylinder;

an inertial measurement unit;

in which the inertial measurement unit is connected to the piston so that motion of the piston causes motion of the inertial measurement unit along an axis; and in which the inertial measurement unit or a data collecting device receiving data from the inertial measurement unit is configured to use measurements taken by the inertial measurement unit of the motion of the inertial measurement unit along the axis to correct or compensate for errors in the alignment of the inertial measurement unit.

2. The apparatus of claim 1 further comprising a fluid drive for the piston to impart linear motion to the inertial measurement unit.

3. The apparatus of claim 2 in which the cylinder has a first end and a second end, and the fluid drive comprises at least a high pressure tank, a first valve, a second valve and a switch configured so that the switch has one state which causes the first valve to connect the high pressure tank to the first end of the cylinder, and a second state which causes the second valve to connect the high pressure tank to the second end of the cylinder.

4. The apparatus of claim 3 in which the fluid drive further comprises a low pressure tank, and in which the fluid drive is configured so that the low pressure tank can be connected via valves to either side of the cylinder.

5. The apparatus of claim 1 further comprising a rotary drive connected to the piston or connected to the inertial measurement unit to impart rotary motion of the inertial measurement unit about the axis.

6. The apparatus of claim 5 further comprising a fluid drive for the piston to impart linear motion to the inertial measurement unit and in which the fluid drive and the rotary drive are interconnected to cause incremental rotation as the inertial measurement unit moves linearly along the axis.

7. The apparatus of claim 1 in which a magnetostrictive sensor is used to measure the motion of the piston or the inertial measurement unit.

8. The apparatus of claim 1 in which the apparatus is part of a measurement-while-drilling system.

9. An apparatus for inertial navigation, comprising:

a capsule;

an inertial measurement unit within the capsule;

a linear drive for the inertial measurement unit;

a rotary drive for the inertial measurement unit:

in which the inertial measurement unit is connected to the linear drive so that the linear drive causes motion of the inertial measurement unit in relation to the capsule along a linear axis; and in which the inertial measurement unit is connected to the rotary drive so that the rotary drive causes rotation of the inertial measurement unit around a rotary axis; and in which the inertial measurement unit or a data collecting device receiving data from the inertial measurement unit is configured to use measurements taken by the inertial measurement unit of the motion of the inertial measurement unit along the linear axis and the rotation of the inertial measurement unit around the rotary axis to correct or compensate for errors in the alignment of the inertial measurement unit.

10. The apparatus of claim 9 in which the linear drive comprises a piston.

11. The apparatus of claim 10 in which the linear drive further comprises a fluid drive to move the piston.

12. The apparatus of claim 9 in which the rotary drive comprises a system to produce rotary motion from linear motion.

13. The apparatus of claim 11 in which a magnetostrictive sensor is used to measure the motion of the piston or the inertial measurement unit.

14. The apparatus of claim 9 in which the apparatus is part of a measurement-while-drilling system.

15. The apparatus of claim 9 in which the rotary drive comprises a threaded cylinder.

16. A method for correcting alignment errors in an inertial navigation system, comprising the steps of:

moving an inertial measurement unit along a linear axis within a capsule containing the inertial measurement unit while simultaneously rotating the inertial measurement unit around a rotary axis;

using the inertial measurement unit to take a measurement of the motion and rotation;

comparing the measurement of the motion and rotation to an expected measurement of the motion and rotation; and using the difference between the measurement and the expected measurement to correct alignment errors.

17. The method of claim 16 in which the expected measurement of the motion is at least in part derived from a measurement of the position of the inertial measurement unit using a magnetostrictive sensor.

18. The method of claim 16 used in a measurement-while-drilling system.

19. A method of correcting or compensating for alignment errors in an inertial navigation system, comprising the steps of:

moving an inertial measurement unit along an axis within a capsule during a time period;

using a magnetostrictive sensor to measure the position of the inertial measurement unit at plural times during the time period;

using the inertial measurement unit to measure acceleration during the time period;

comparing the measurements of the position by the magnetostrictive sensor to the measurements of the acceleration by the inertial measurement unit to estimate errors in the alignment of the inertial measurement unit; and using the estimates of the errors in the alignment of the inertial measurement unit to correct or compensate for the errors.

20. The method of claim 19 used in a measurement-while-drilling system.

* * * * *